US009610515B2

(12) United States Patent
Rehkemper et al.

(10) Patent No.: US 9,610,515 B2
(45) Date of Patent: Apr. 4, 2017

(54) SYSTEM TO LAUNCH A TOY ENTITY AND METHODS OF PLAY

(71) Applicant: Rehco, LLC, Chicago, IL (US)

(72) Inventors: Steven Rehkemper, Chicago, IL (US); Michael Kadile, Redondo Beach, CA (US)

(73) Assignee: Rehco, LLC, Chicago, IL (US)

( * ) Notice: Subject to any disclaimer, the term of this patent is extended or adjusted under 35 U.S.C. 154(b) by 689 days.

(21) Appl. No.: 13/775,587

(22) Filed: Feb. 25, 2013

(65) Prior Publication Data

US 2014/0239591 A1 Aug. 28, 2014

(51) Int. Cl.
*A63H 27/14* (2006.01)
*A63H 17/00* (2006.01)

(52) U.S. Cl.
CPC ..... *A63H 27/14* (2013.01); *A63H 17/008* (2013.01)

(58) Field of Classification Search
USPC ..... 273/317; 446/38, 41, 45, 60, 279, 429; 124/78
See application file for complete search history.

(56) References Cited

U.S. PATENT DOCUMENTS 3,473,256 A * 10/1969 Tyler ..... A63H 27/14 446/38
3,701,216 A * 10/1972 Smith, III ..... A63F 7/2472 185/39
5,129,852 A * 7/1992 Crisci ..... A63H 29/18 446/60
5,525,086 A * 6/1996 Gentile ..... A63H 27/14 446/234
7,727,047 B2 * 6/2010 Lopez ..... A63H 27/14 446/41
8,128,454 B2 * 3/2012 Rosenblum ..... A63H 17/008 446/236
8,696,401 B2 * 4/2014 Ichikawa ..... A63H 29/20 446/429
8,955,503 B2 * 2/2015 Corsiglia ..... F42B 6/00 124/78
2006/0183399 A1 * 8/2006 Sze ..... A63H 27/12 446/45
2007/0099541 A1 * 5/2007 Yu ..... A63H 17/008 446/429
2008/0096460 A1 * 4/2008 Sandoval ..... A63H 17/008 446/279

* cited by examiner

*Primary Examiner* — Aarti B Berdichevsky
*Assistant Examiner* — Christopher Glenn
(74) *Attorney, Agent, or Firm* — Brooks Kushman P.C.

(57) ABSTRACT

A system is provided having a launch mechanism with an energy generation capability and a capability to launch toy entities such as surface based entities and flying entities. The launch mechanism may include multiple orientations and configurations to facilitate launch sequences for the toy entities. The energy generation capability may include a handle, a trigger and a rack extending from the trigger capable of charging a gear box. The launch mechanism may also include a capability to transfer energy from the gear box to the toy entity. The system may also be used with game play to launch the flying entities and then utilize an upper portion of the launch mechanism to catch the flying entities.

12 Claims, 22 Drawing Sheets

SYSTEM TO LAUNCH A TOY ENTITY AND METHODS OF PLAY

FIELD OF THE INVENTION

The illustrative embodiments relate to a system with a launch mechanism for launching toy entities and a method of game play.

BACKGROUND OF THE INVENTION

There have been varieties of children's toys that involve spinning tops and launching vehicles. These toys are often difficult for younger users to operate. A continual need for improvements in or additions to play, along with improvements in mechanics provide for new arrangements which improve, create or change the play and interaction between a child and the toy. Numerous other advantages and features of the invention become readily apparent from the following detailed description of the invention and embodiments thereof and from the accompanying drawings.

BRIEF SUMMARY OF THE INVENTION

In one or more illustrative embodiments of the present invention there is provided a system to launch a flying entity. The system may include a launch mechanism with an energy generation capability and a removeable upper portion with an aperture. The energy generation capability may include a handle, a trigger and a rack extending from the trigger capable of charging a gear box. The gear box may be configured to rotate a transfer fixture with a first shaped surface. The flying entity may include a propeller and a launch fixture with a second shaped surface. The system may also include a capability to transfer energy from the transfer fixture to the launch fixture such that the launch mechanism may be configured to generate and charge the gear box when a user squeezes the trigger and thus may transfer energy from the transfer fixture to the launch fixture such that the propeller generates lift to direct the flying entity to take flight. The first shaped surface and second shaped surface may be configured to facilitate a meshed communication to transfer energy, and to facilitate a disengagement of the meshed communication. The upper portion may include a surface sloped toward the aperture and a lip around an outer edge of the upper portion. The surface and lip may direct the flying entity toward the aperture when spinning and in contact with the surface. Additionally, the launch mechanism may be removeably attached to a projectile launcher which may launch projectiles at the flying entity when in flight. The launch mechanism may also include a second configuration to launch a second flying entity where the upper portion may be removed to utilize a second transfer fixture which may have a first shaped surface. The gear box may further be configured to rotate the second transfer fixture when charged by the rack. The second flying entity may include a second propeller and a second launch fixture with a second shaped surface. In the second configuration, the launch mechanism may be configured to generate energy and charge the gear box when a user squeezes the trigger, and then may transfer the energy to the second launch fixture such that the second propeller generates lift to direct the second flying entity to take flight.

In another illustrative embodiment there is provided another system to launch a toy entity. The system may include a launch mechanism with an energy generation capability. The energy generation capability may include a handle with a trigger. A rack may extend from an upper portion of the trigger with a capability to charge the gear box which may be configured to rotate the transfer fixture. The entity may include a drive element and a launch fixture such that the drive element may be capable of directing movement of the entity when charged. The transfer fixture and launch fixture may include a relationship configured to facilitate a communication to transfer energy and to facilitate a disengagement of the communication. The launch mechanism may be configured to generate energy and charge the gear box when a user squeezes the trigger, and transfer energy from the transfer fixture to the launch fixture such that the drive element directs the entity to launch. Additionally, the entity may be a flying entity where the drive element is a propeller. The launch fixture and transfer fixture may be configured to facilitate a meshed communication, and to facilitate a disengagement of the meshed communication when lift generated by the propeller directs the flying entity to take flight. The upper portion may include a surface sloped toward the aperture and a lip around an outer edge of the upper portion. The surface and lip may direct the flying entity toward the aperture when spinning and in contact with the surface. The entity may also be a driving entity where the drive element is a wheel with the launch fixture fixed at a central axis of the wheel. The relationship between the transfer fixture and launch fixture may be configured to facilitate a meshed communication, and facilitate a disengagement of the meshed communication to launch the driving entity.

In another illustrative embodiment there is provided a system to launch a toy flying entity and a toy driving entity. The system may include a launch mechanism with a vertical orientation, a horizontal orientation, and an energy generation capability. The launch mechanism may also include a removeable upper portion with an aperture positioned above a transfer fixture when in the vertical orientation. The upper portion may be removed to utilize the launch mechanism in the horizontal orientation. The energy generation capability may include a handle, a trigger and a rack extending from an upper portion of the trigger capable of charging a gear box. The gear box may be configured to rotate the transfer fixture with a first shaped surface when charged by the rack. The flying entity may include a propeller and a flying launch fixture. The driving entity may include at least one wheel and a driving launch fixture secured at a center axis of the wheel. Both the flying launch fixture and driving launch fixture may include a second shaped surface. The first shaped surface and second shaped surface may include a relationship configured to facilitate a meshed communication to transfer energy and to facilitate a disengagement of the meshed communication. In the vertical orientation, the launch mechanism may be configured to generate energy and charge the gear box when a user squeezes the trigger, and to transfer energy to the propeller to generate lift and direct the flying entity to take flight. In the horizontal orientation, the launch mechanism may be configured to generate energy and charge the gear box when a user squeezes the trigger, and to transfer the energy to wheel to direct the driving entity to launch forward. The system may also include a pinch prevention capability positioned between the trigger and handle.

In yet another illustrative embodiment, a game with a set of rules and a system to launch a flying entity including a launch mechanism may be provided. The flying entity may include a propeller and launch fixture. The launch mechanism may include an energy generation capability with a handle, trigger and a rack extending from an upper portion of the trigger capable of charging the gear box. The gear box may be configured to rotate a transfer fixture when charged by the rack. An upper portion of the launch mechanism may include a lip and a surface sloped toward an aperture positioned above the transfer fixture. The system may also include a capability to transfer energy to the propeller to generate lift and direct the flying entity to take flight. The rules may direct a player to position the flying entity at a ready position, then launch the flying entity, then catch the flying entity in the upper portion of the launch mechanism while manipulating the launch mechanism such that the flying entity returns to the ready position. A projectile launcher may also be provided to shoot down the flying entity when in flight and in accordance to game rules. A second launch mechanism may be provided for a second player, such that the players may "toss" the flying entity back and forth to one another.

In yet another illustrative embodiment there is provided a system to launch a first flying entity and a second flying entity. The system may include a launch mechanism with a first configuration, a second configuration, an energy generation capability and a removeable upper portion with an aperture positioned above a first transfer fixture. Removing the upper portion to utilize a second transfer fixture may further define the second configuration. The energy generation capability may include a handle, a trigger and a rack extending from an upper portion of the trigger capable of charging a gear box. The gear box may be configured to rotate the first transfer fixture and second transfer fixture. The first flying entity may include a first propeller and a first launch fixture. The second flying entity may include a second propeller and a second launch fixture. A relationship between the transfer fixtures and launch fixtures may be configured to facilitate a meshed communication to transfer energy, and to facilitate a disengagement of the meshed communication. In the first configuration, the launch mechanism may be configured to generate energy and charge the gear box when a user squeezes the trigger, and to transfer energy to the first propeller to generate lift and direct the first flying entity to take flight. In the second configuration, the launch mechanism may be configured to generate energy and charge the gear box when a user squeezes the trigger, and to transfer energy to the second propeller to generate lift and direct the second flying entity to take flight.

In yet another illustrative embodiment there is provided a system which may launch a first entity and a second entity. The system may include a launch mechanism with a first launching capability, a second launching capability, an energy generation capability, and a first transfer fixture and a second transfer fixture each including a first shaped surface. The energy generation capability may include a handle, a trigger, and a rack extending from an upper portion of the trigger capable of charging a gear box. The gear box may be configured to rotate the first transfer fixture and second transfer fixture. The first entity may include a first launch fixture with a second shaped surface. The second entity may include a wheel with a second launch fixture including a second shaped surface. The first shaped surfaces and second shaped surfaces may include a relationship configured to facilitate a meshed communication to transfer energy and to facilitate a disengagement of the meshed communication. The first launching capability may be configured to generate energy and charge the gear box when a user squeezes the trigger, and to transfer energy to the first entity to disengage the meshed communication and direct the first entity to spin in a top-like manner. The second launching capability may be configured to generate energy and charge the gear box when a user squeezes the trigger, and to transfer energy to the second entity to disengage the meshed communication and direct the second entity to launch forward.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DESCRIPTION OF THE EMBODIMENTS

Figure 1A:
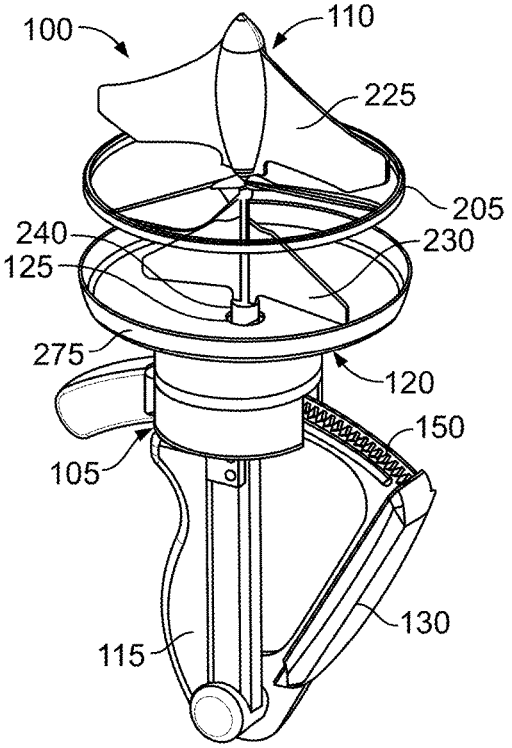
FIG. 1*a* is a perspective view of an illustrative system with an exemplary launch mechanism in a vertical orientation and an exemplary flying entity.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention, claims or the embodiments illustrated.

Figure 1B:
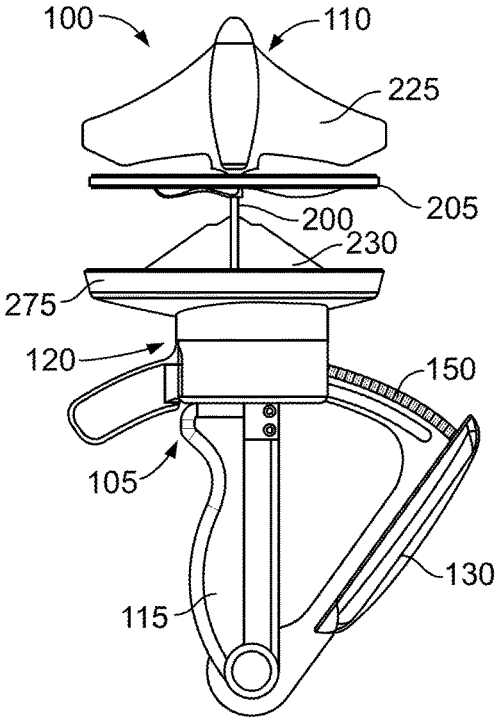
FIG. 1*b* is a side view of FIG. 1*a;*
Figure 2A:
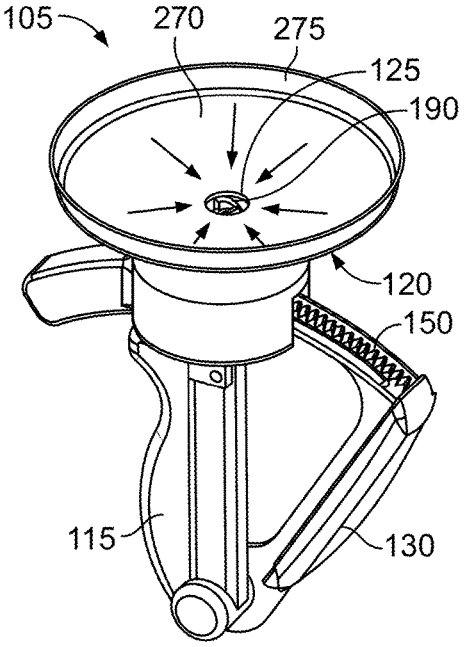
FIG. 2*a* is a perspective view of an illustrative launch mechanism.
Figure 2B:
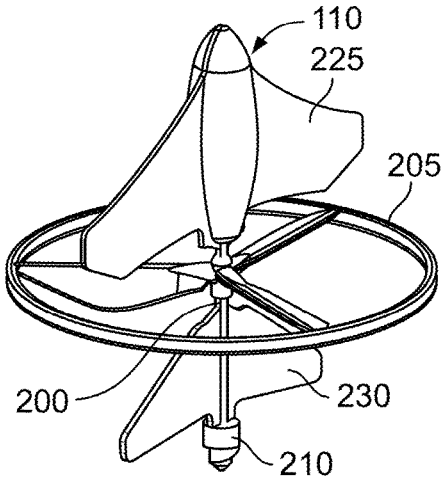
FIG. 2*b* is a perspective view of an illustrative flying entity.
Figure 3:
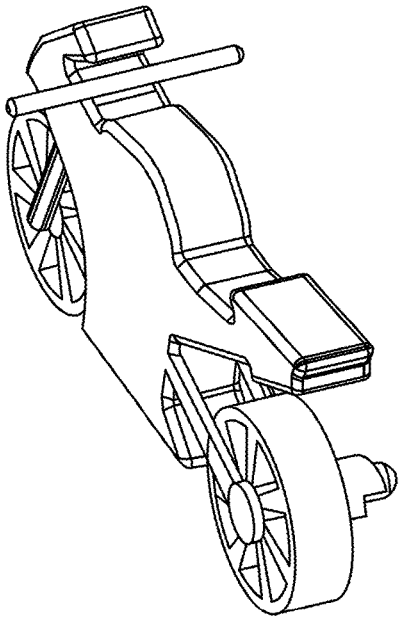
FIG. 3 is a perspective view of an illustrative driving entity.
Figure 4:
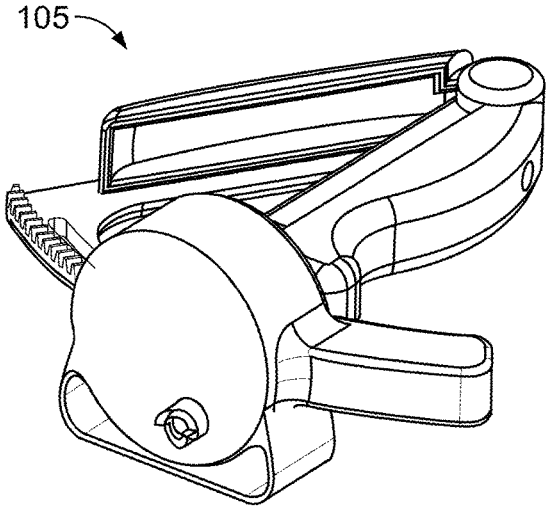
FIG. 4 is a perspective view of an illustrative launch mechanism in a horizontal orientation.
Figure 5:
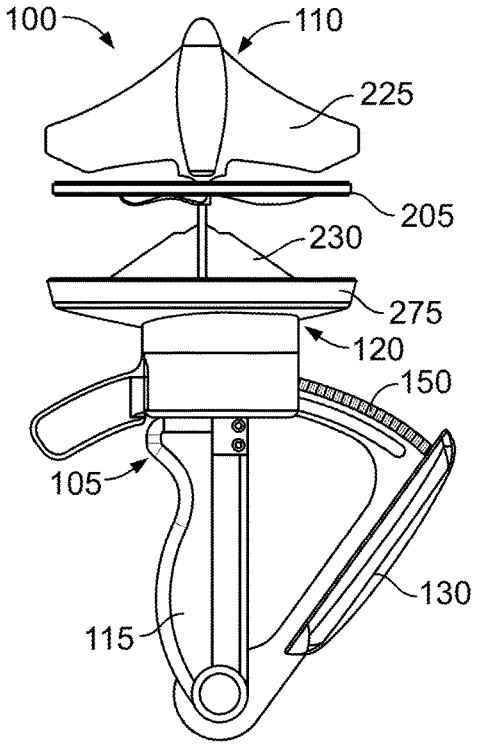
FIG. 5 is a side view of an illustrative system where an exemplary trigger of an exemplary launch mechanism is in an open position.
Figure 6:
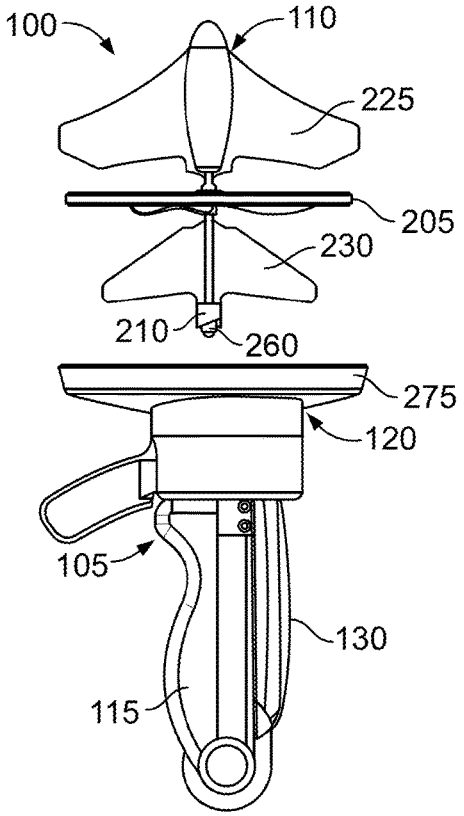
FIG. 6 is a side view of an illustrative system where an exemplary trigger of an exemplary launch mechanism is a closed position and an exemplary flying entity is in flight.
Figure 7:
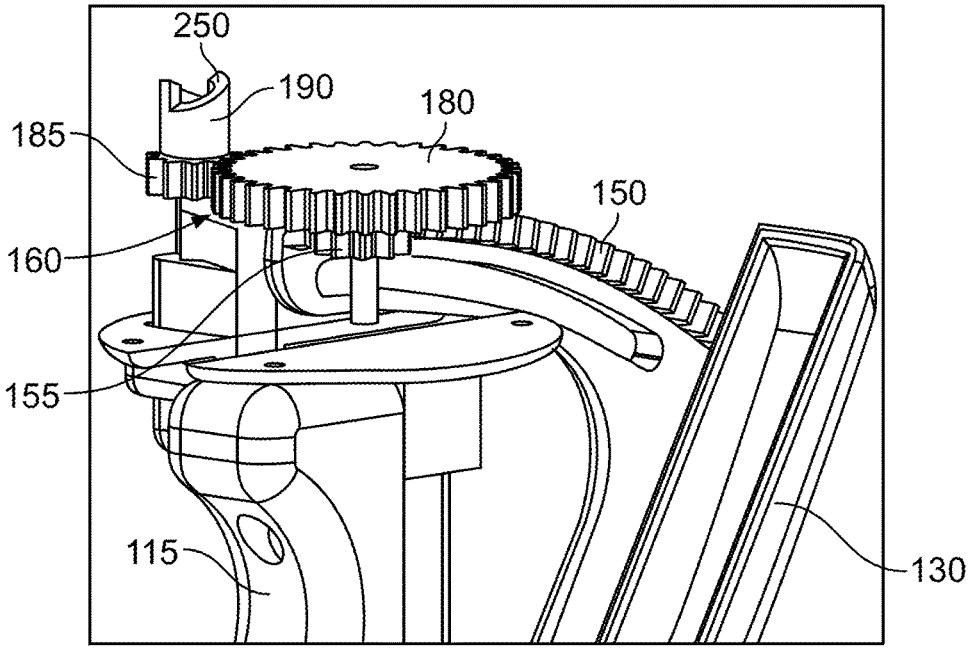
FIG. 7 is a perspective view of an exemplary launch mechanism with an outer housing removed and an exemplary trigger in an open position.
Figure 8:
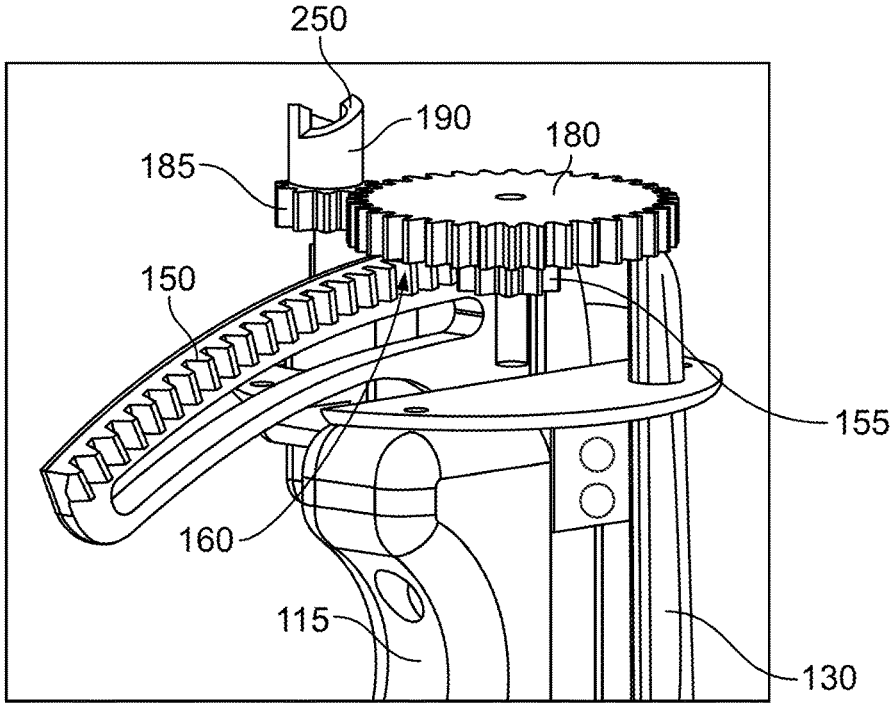
FIG. 8 is a detailed perspective view of the launch mechanism with an outer housing removed and an exemplary trigger in a closed position.

Referring now to FIGS. 1*a*-4, there is shown an illustrative system for launching toy entities which may include an exemplary launch mechanism 105. The launch mechanism may include an energy generation capability to charge an entity drive element to facilitate entity launch. Types of entities may include, but are not limited to, flying toys which may include a propeller as a drive element and surface-based driving toys which may include a wheel as a drive element. FIGS. 1*a*-2*b* illustrate an exemplary vertical orientation of the launch mechanism 105 for utilization with flying entities. FIG. 3 illustrates an exemplary driving entity which may be utilized with an exemplary horizontal orientation of the launch mechanism 105 shown in FIG. 4.

Continuing to refer to FIGS. 1-2*b* and now additionally FIGS. 5-11*b*, there is shown a system 100 which may include an exemplary launch mechanism 105 with an energy generation capability, a capability to launch a flying entity 110, and a capability to launch a driving entity in accordance with one illustrative embodiment. The launch mechanism 105 may include a handle 115, an upper portion 120 with an aperture 125, a trigger 130 with a lower portion pivotally attached to the handle 115 at a trigger axis 131 and optionally a spring (not shown), such as a torsion spring, which may bias movement of the trigger 130 away from the handle 115. An upper portion of the trigger 130 may include a rack 150 extending therefrom and meshed with a pinion gear 155 included in an exemplary gear box 160. It should be noted that alternative gear box structures and/or configurations may be utilized. The pinion gear 155 and a transfer gear 180 may rotate in accordance with rack 150 movement. A second gear 185 and a transfer fixture 190 may be meshed to the transfer gear 180. The transfer fixture 190 may be aligned with the aperture 125 to further facilitate a communication with the flying entity 110 as described below.

Figure 9:
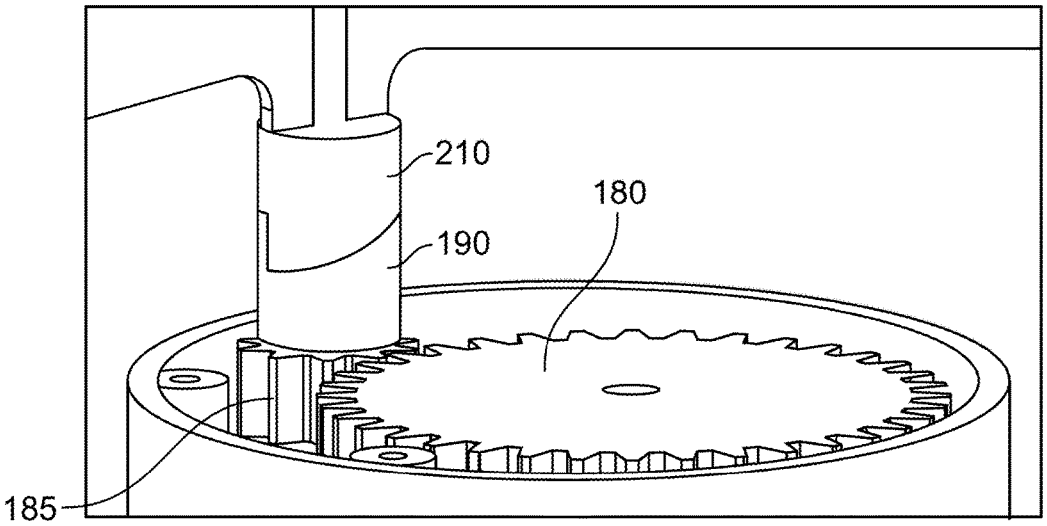
FIG. 9 is a detailed perspective view of an exemplary meshed communication between an exemplary transfer fixture and an exemplary launch fixture.
Figure 10:
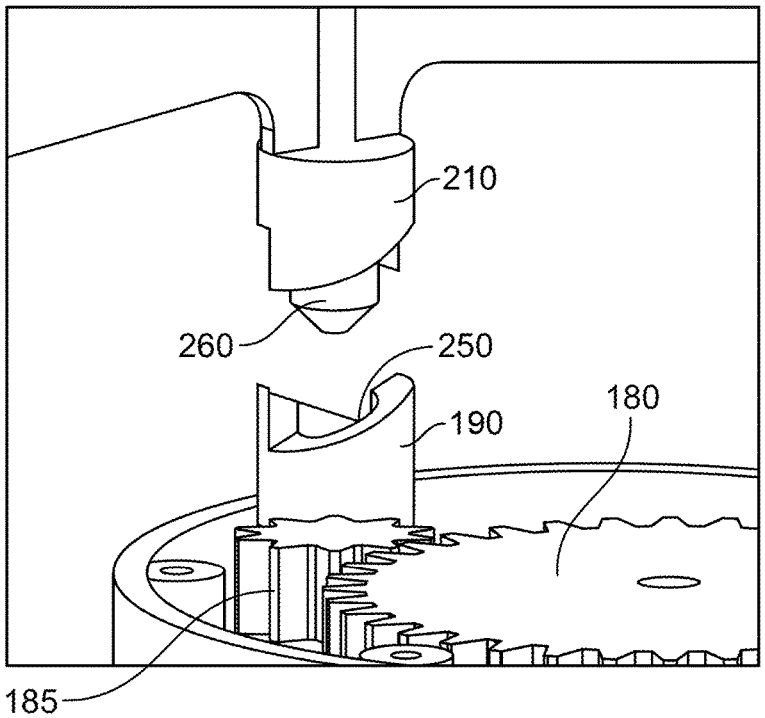
FIG. 10 is a detailed perspective view of disengaged position of the transfer fixture and launch fixture from FIG. 9.

The flying entity 110 may include an entity shaft 200 with a propeller 205 fixed thereto and a launch fixture 190 fixed to a lower portion of the entity shaft 200 such that the entity shaft 200, propeller 205 and launch fixture 210 spin simultaneously as directed. Additionally and optionally, one or more character elements may be positioned to rotate freely about the entity shaft 200. Examples of character elements include but are not limited to an upper plane portion 225 and a lower plane portion 230. Examples of flying entities include but may not limited to planes and helicopters. The system 100 may also include a capability to transfer energy from the transfer fixture 190 to the launch fixture 210. Continuing to refer to FIGS. 5-11, in one exemplary embodiment, the transfer fixture 190 may include a cavity and a first shaped surface 250. The launch fixture 210 may include a second shaped surface 255 and an extension 260. The cavity may be shaped to receive the extension 260. The first shaped surface 250 and second shaped surface 255 may be configured to facilitate a meshed communication as shown in FIG. 9. Further the first shaped surface 250 and second shaped surface 255 may be configured to facilitate disengagement of the meshed communication and launch of the flying entity 110. FIG. 10 shows the transfer fixture 190 and the launch fixture 210 disengaged. Two exemplary illustrations of disengagement occur when (i) lift generated by the propeller 205 directs the flying entity 110 to take flight, and (ii) the spinning movement of transfer fixture 190 is stopped.

Referring now again to FIGS. 7 and 8, as described above one illustrative energy generation capability utilizes an exemplary rack and pinion combination to charge the gear box 160 and initiate rotation of the transfer fixture 190. Energy is transferred to the flying entity 110 via the meshed communication between transfer fixture 190 and launch fixture 210. FIG. 9 shows a detailed view of an engaged position where the launch fixture 210 is in meshed communication with the transfer fixture 190 and the flying entity 110 is ready for launch. The energy generation capability may require only one hand of a user to initiate an illustrative launch sequence now described. Squeezing the trigger 130 initiates a launch sequence as the rack 150 moves with the trigger 130 to charge the gear box 160 by spinning the pinion gear 155, transfer gear 180 and transfer fixture 190 in accordance thereto. As such, the transfer fixture 190 spins the launch fixture 210, entity shaft 200 and propeller 205, directing the flying entity 110 to take flight at a disengagement of the meshed communication and/or as the propeller generates lift. FIG. 10 shows the launch fixture 210 disengaged from the transfer fixture 190.

Figure 11A:
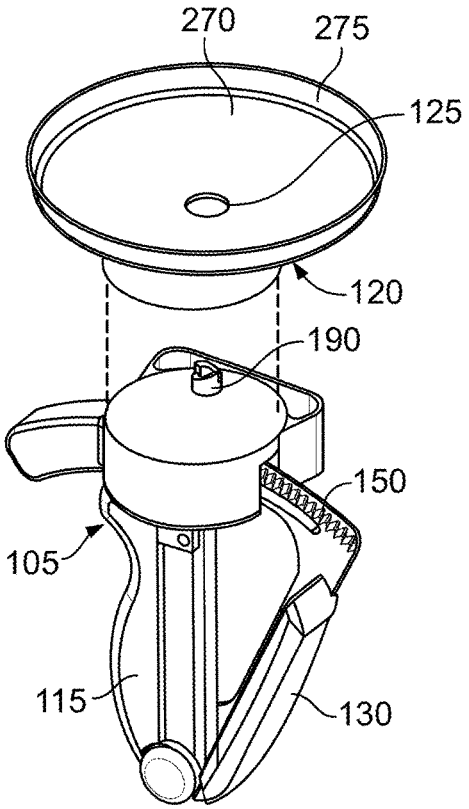
FIG. 11*a* is a perspective view of an exemplary launch mechanism showing an exemplary upper portion removed.
Figure 11B:
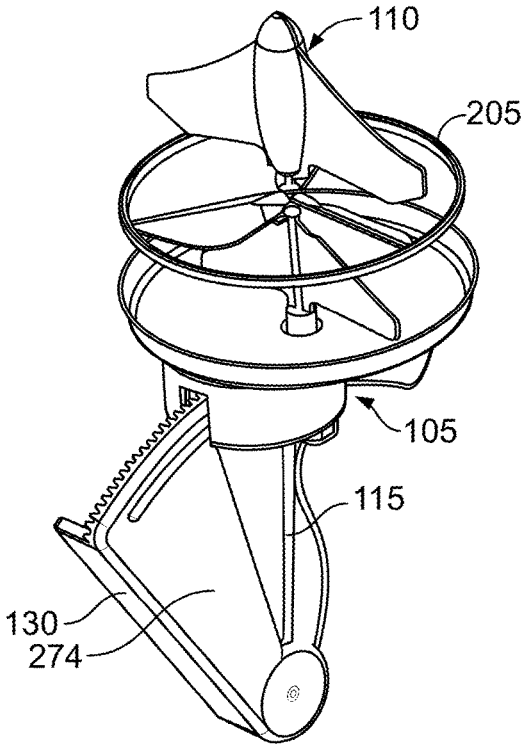
FIG. 11*b* is a rear perspective view of an exemplary launch mechanism where a housing of an exemplary handle is removed to show an exemplary plate positioned between the trigger and handle.

Optionally, the launch mechanism 105 may include a pinch prevention capability between the handle 115 and trigger 130 when initiating a launch sequence by squeezing the trigger 130. A trigger plate 274 may extend from the handle 115 or trigger 130 as shown in FIG. 11*b* such that the trigger plate 274 may prevent material and/or debris from being positioned between the handle 115 and trigger 130 which might hinder operation of the launch mechanism 105. A housing portion of the handle 115 is removed in FIG. 11*b* to show the optional trigger plate 274. In one illustrative example, the pinch prevention capability may operate as a safety function by preventing insertion of a user's finger between the handle 115 and trigger 130 when squeezing the trigger 130. The positioning, size, and shape of the trigger plate 274 are such that operation of the energy generation capability is not hindered. Further, another exemplary pinch prevention capability may include one or more plates between the handle 115 and trigger 130.

The system 100 may also include a capability to catch and reset the flying entity 110 following the launch sequence and flight of the flying entity 110. The upper portion 120 may include a plate 270 with a sloped surface and a lip 275 extending upward around an edge of the upper portion 120. The sloped surface may be shaped to slope toward the aperture 125 as shown with directional arrows in FIG. 2*a*. As the flying entity 110 descends a user may position the launch mechanism 105 below the flying entity 110 such that the launch fixture 190 contacts the sloped surface of the plate 270. An appropriate amount of balance and manipulation of the launch mechanism 105 enables a user to utilize the sloped surface of the plate 270 to direct the still spinning launch fixture 190 toward the aperture 125. Additionally, the lip 275 may prevent the flying entity 110 from spinning off of the upper portion 120 and upon contact, redirect the spinning flying entity 110 toward the aperture 125 to reset the launch sequence when the launch fixture 210 engages the transfer fixture 190. As such, a user may play a game of launch and catch as now described.

Figure 12A:
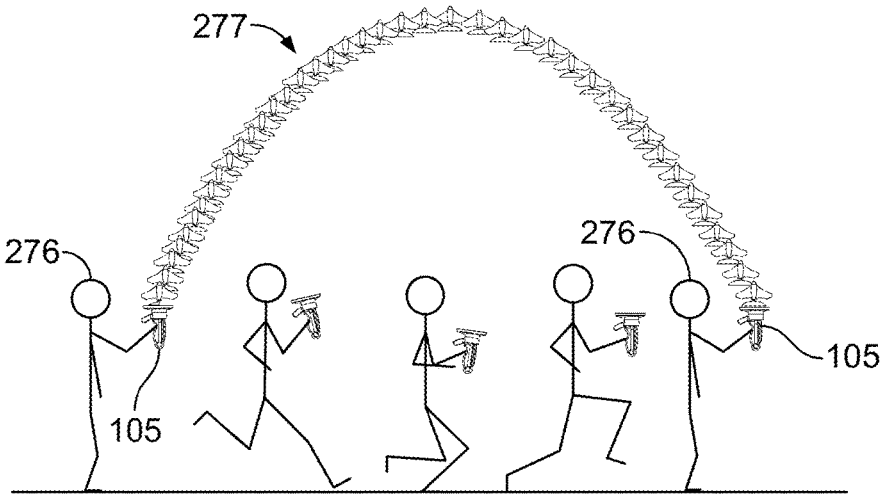
FIG. 12*a* is side view of one exemplary sequence of game play.
Figure 12B:
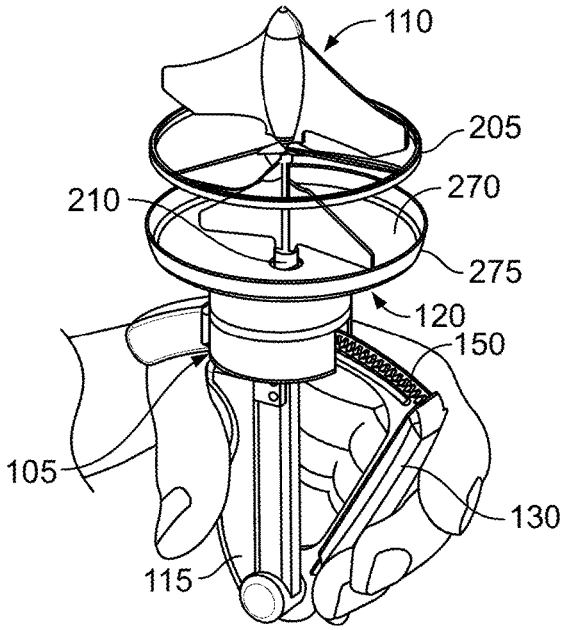
FIG. 12*b* is a perspective view of a step in one exemplary sequence of game play.
Figure 12C:
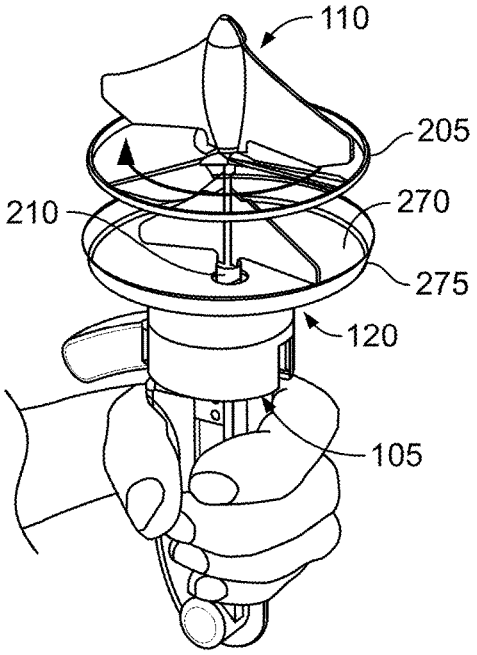
FIG. 12*c* is a perspective view of a step in one exemplary sequence of game play.
Figure 12D:
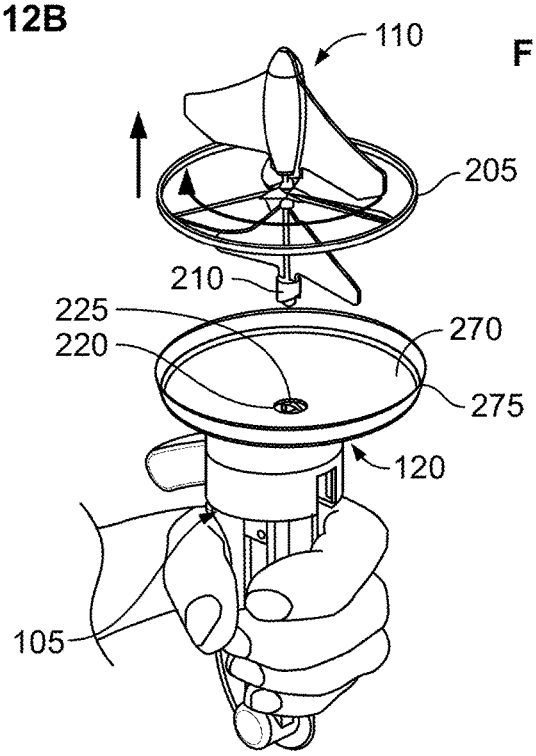
FIG. 12*d* is a perspective view of a step in one exemplary sequence of game play.
Figure 12E:
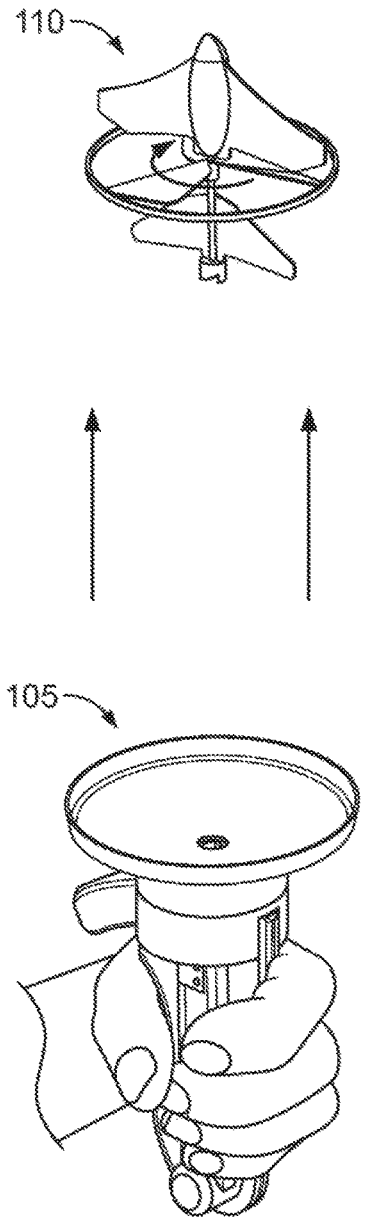
FIG. 12*e* is a perspective view of a step in one exemplary sequence of game play.
Figure 12F:
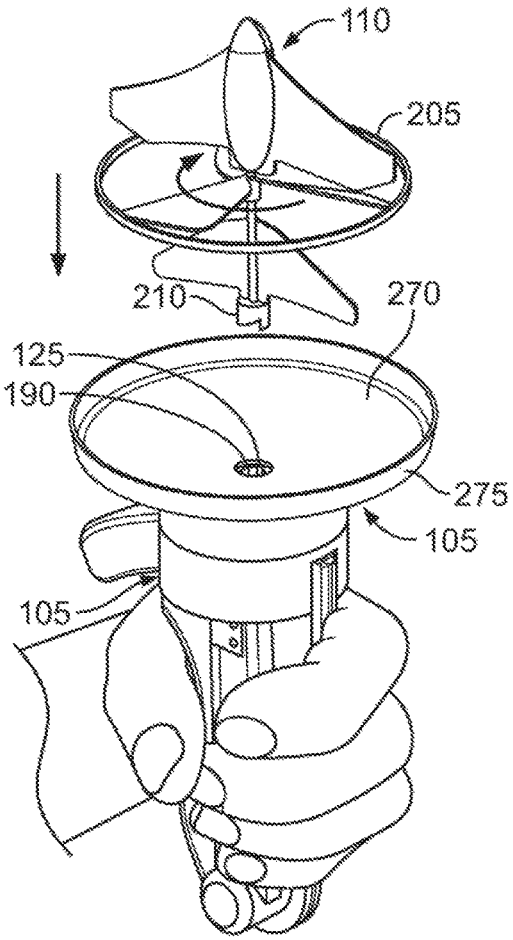
FIG. 12*f* is a perspective view of a step in one exemplary sequence of game play.
Figure 12G:
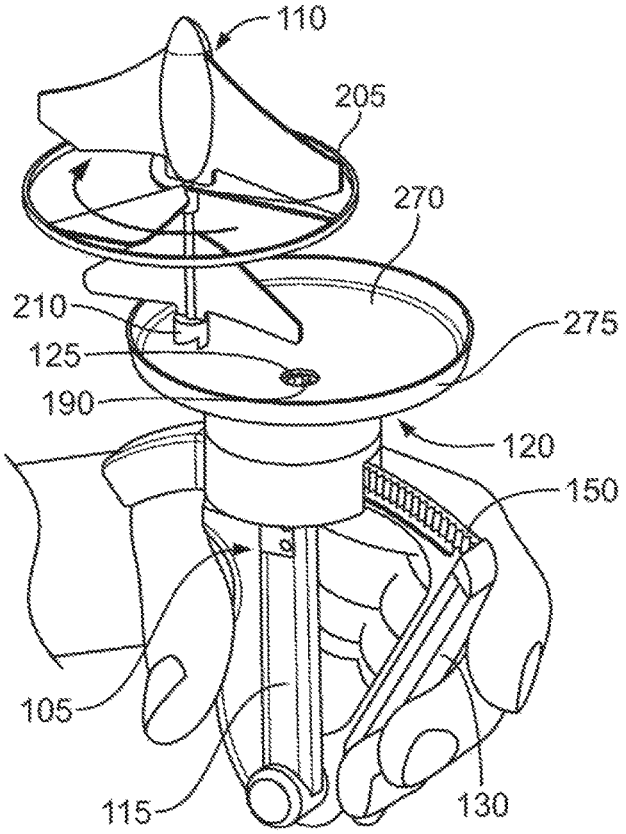
FIG. 12*g* is a perspective view of a step in one exemplary sequence of game play.
Figure 12H:
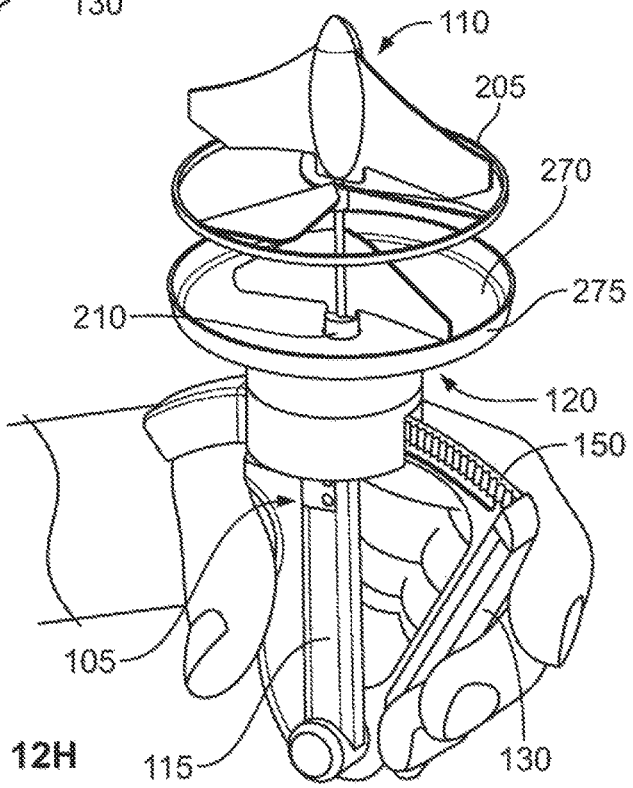
FIG. 12*h* is a perspective view of a step in one exemplary sequence of game play.

Now referring to FIGS. 12*a*-12*h*, the illustrative system 100 may be utilized with an illustrative method of game play where a user is provided the system 100 with the launch mechanism 105 and the capability to launch the flying entity 110 as described above. In this exemplary embodiment of game play, the flying entity 110 may also be provided and include the entity shaft 200 with propeller 205 secured thereto, and the launch fixture 210 may be fixed to one end of the entity shaft 200. The system 100 may also include a capability to transfer energy from the transfer fixture 190 to the launch fixture 210 to spin the flying entity 110 such that the propeller 205 generates lift to direct the flying entity 110 to take flight as described above. Alternatively and/or in addition to, a stopper may be included to stop rotation of the transfer fixture 190 at a desired interval. FIG. 12*a* illustrates one exemplary sequence of game play where (i) a user 276 launches the flying entity 110 from the launch mechanism 105; (ii) the flying entity 110 ascends and descends in a flight path 277; (iii) and the user 276 moves to position the launch mechanism 105 below the flying entity 110 to catch the same. To commence exemplary game play, a player is directed to position the launch fixture 210 in meshed communication with the transfer fixture 190 to define a ready position as shown in FIG. 12*b*. The player may then be directed to squeeze the trigger 130 as shown in FIG. 12*c* to energize the gear box 160 and transfer fixture 190 which may direct the launch fixture 210 to spin the flying entity 110 such that the propeller 205 generates lift to direct the flying entity 110 to take flight as shown in FIG. 12*d*. Once the flying entity 110 is in flight as shown in FIG. 12*e*, the object of this exemplary game is to "catch" the flying entity 110 before landing and/or crashing on a surface. As such, the player is directed to follow the flight of the flying entity 110 and position the upper portion 120 below the flying entity 110 in preparation for receipt. FIG. 12*f* shows the flying entity 110 descending toward the upper plate 270. Upon successful positioning of the upper portion 120, the flying entity 110 may continue spinning when the launch fixture 210 contacts the upper plate 270 as shown in FIG. 12*g*. Once the launch fixture 190 contacts the upper plate portion 120, the player may manipulate the upper plate portion 120 to utilize the lip 275 and sloped surface of the plate 270 to direct the launch fixture 210 toward the aperture 125. A player may win or score points by returning the flying entity 110 to the ready position as shown in FIG. 12*h*. In the event a user is not able to catch and reset the flying entity 110 to the ready position, the user may manually reposition the flying entity 110 in the ready position and begin game play again. Additionally, alternative styles of flying entities, including but not limited to a helicopter or bird, may be utilized to expand and/or vary game play. Game play may also include more than one launch mechanism so that two players may pass the flying entity back and forth.

Figure 13:
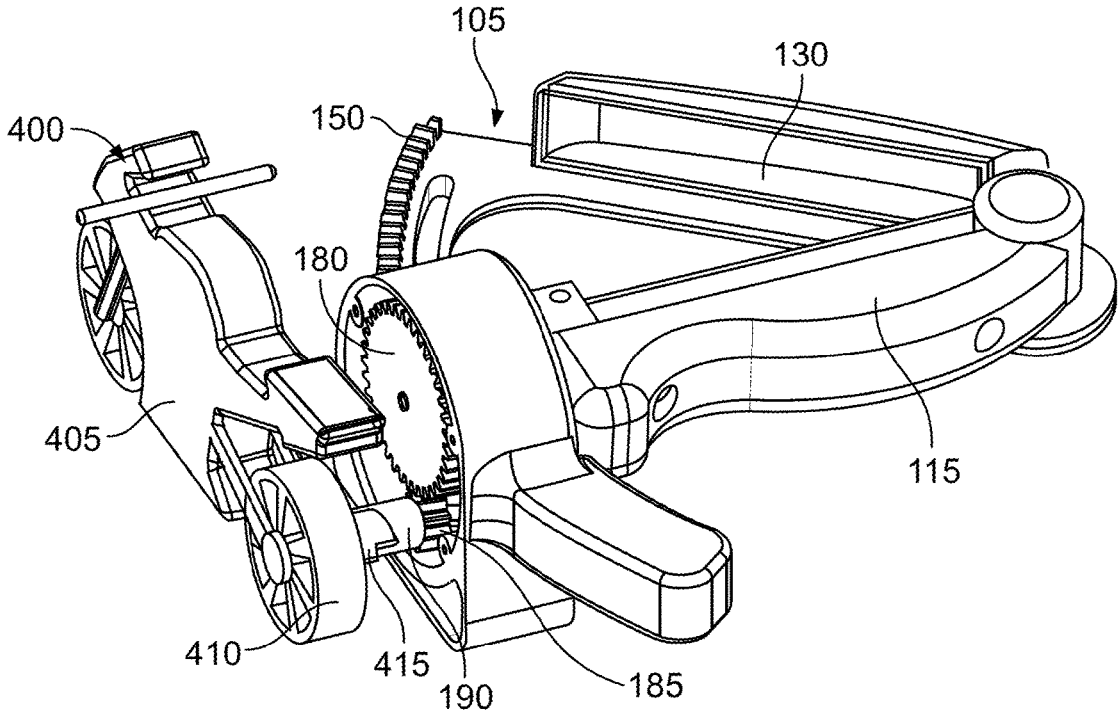
FIG. 13 is a perspective view of an illustrative system with the launch mechanism from FIG. 1 in a horizontal position with an exemplary upper portion removed and an exemplary driving entity.
Figure 14:
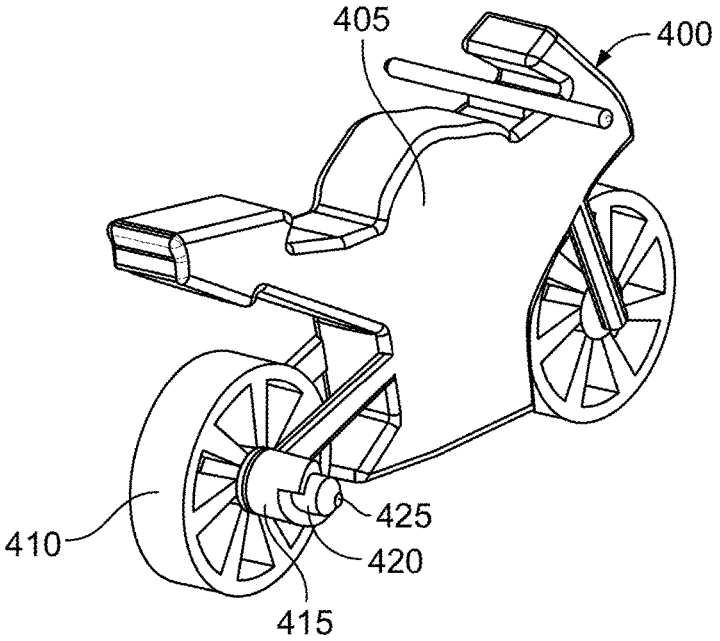
FIG. 14 is a perspective view of the driving entity from FIG. 13.
Figure 15:
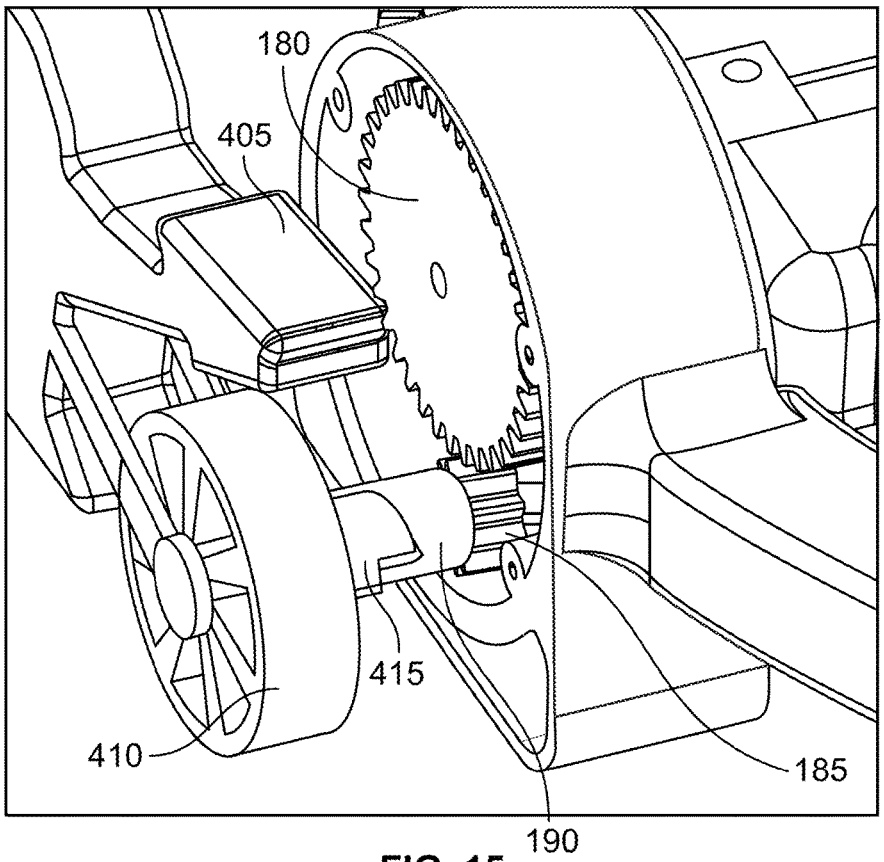
FIG. 15 is a detailed perspective view of FIG. 13 where a housing is removed from the launch mechanism and showing an engagement between an exemplary transfer fixture and an exemplary launch fixture.
Figure 16:
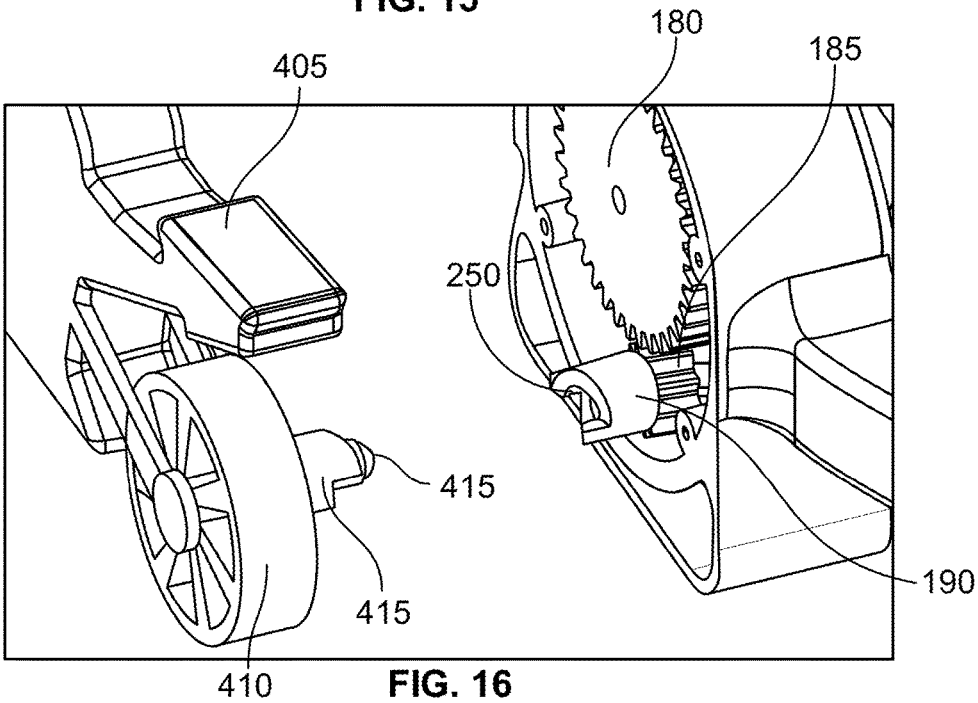
FIG. 16 is an detailed perspective view of the illustrative system from FIG. 13 showing an exemplary transfer fixture and an exemplary launch fixture disengaged.
Figure 17:
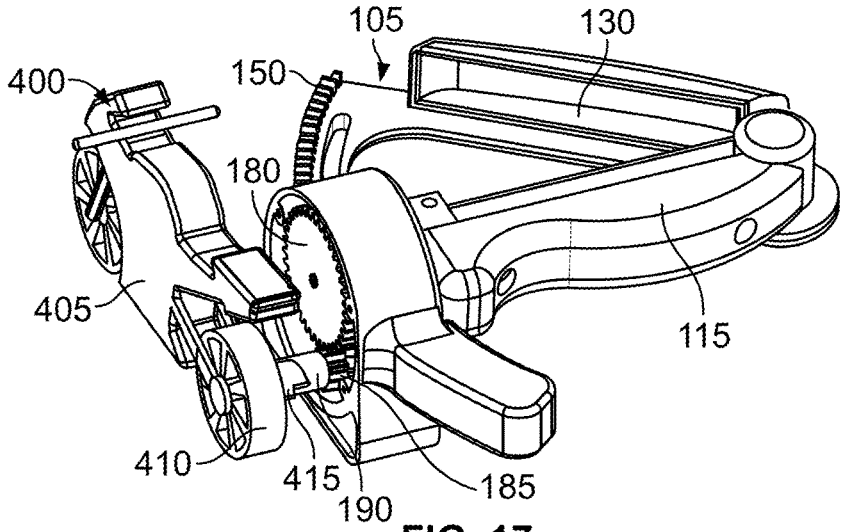
FIG. 17 is a perspective view of an illustrative system with the launch mechanism from FIG. 1 in a horizontal position with an exemplary upper portion removed, an exemplary trigger in an open position, and an exemplary driving entity.
Figure 18:
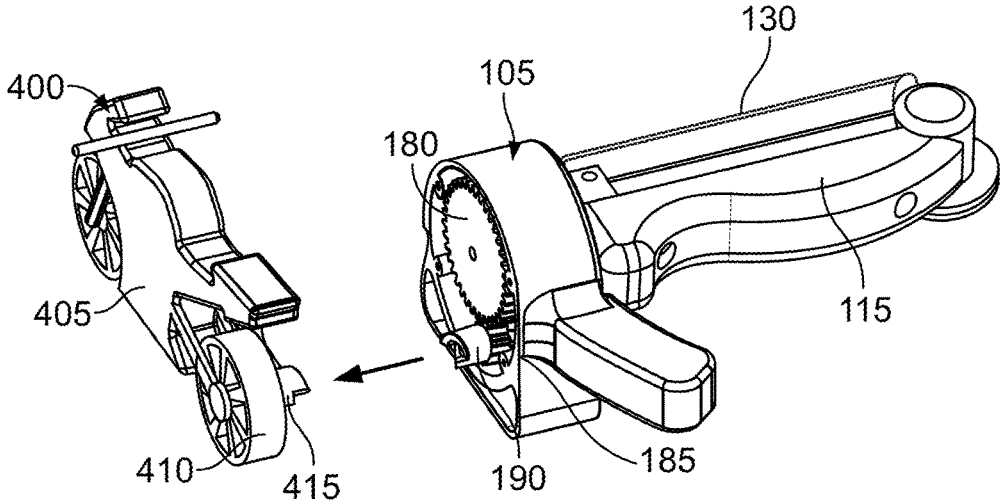
FIG. 18 is a perspective view of the launch mechanism and driving entity from FIG. 17 where the exemplary trigger is in a closed position and the driving entity disengaged from the launch mechanism.
Figure 19:
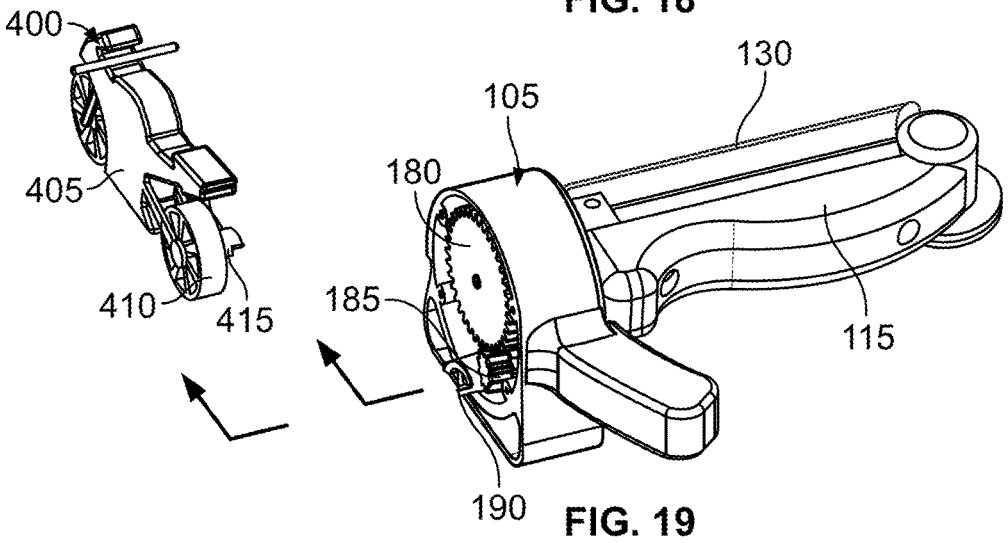
FIG. 19 is a perspective view of the launch mechanism and driving entity from FIG. 17 where the driving entity has launched.

Now referring to FIGS. 13-19, the exemplary system 100 may also include a capability to launch a surface-based driving entity 400. The upper portion 120 of the launch mechanism 105 may be removed to enable horizontal orientation of the launch mechanism 105 as shown in FIG. 13. The driving entity 400, such as a toy motorcycle, may include a chassis 405 with two wheels rotatably attached thereto. This exemplary driving entity 400 may utilize a rear wheel as a drive element 410. A launch fixture 415 may be fixed to the center of the drive element 410 with a second shaped surface 420 and an extension 425. The front wheel of a toy motorcycle may also be utilized as the drive element where a launch fixture is appropriately attached thereto. Further, a toy vehicle with more than two wheels, such as a car or truck, may also utilize the exemplary system 100 in a horizontal orientation. Other exemplary embodiments may utilize a drive element positioned with the driving entity. For example, a flywheel may be in communication with the launch mechanism and configured to direct movement of the driving entity. The first shaped surface 250 of the transfer fixture 190 and second shaped surface 420 may be configured to facilitate a meshed communication as shown in FIGS. 13, 15 and 17. Further, the first shaped surface 250 and second shaped surface 420 may be configured to facilitate disengagement of the meshed communication. When in the meshed communication, the drive element 410 may be elevated off of a surface such that the drive element 410 does not contact the surface prior to disengagement. To initiate a driving launch sequence, a user squeezes the trigger 130 to charge the gear box 160 and transfer fixture 190 to generate energy. The meshed communication between the transfer fixture 190 and launch fixture 415 facilitates a transfer of energy to the drive element 410. Upon disengagement of the meshed communication, the drive element 415 contacts the surface and the driving entity 400 launches forward on the surface as shown in FIGS. 18 and 19.

Figure 20:
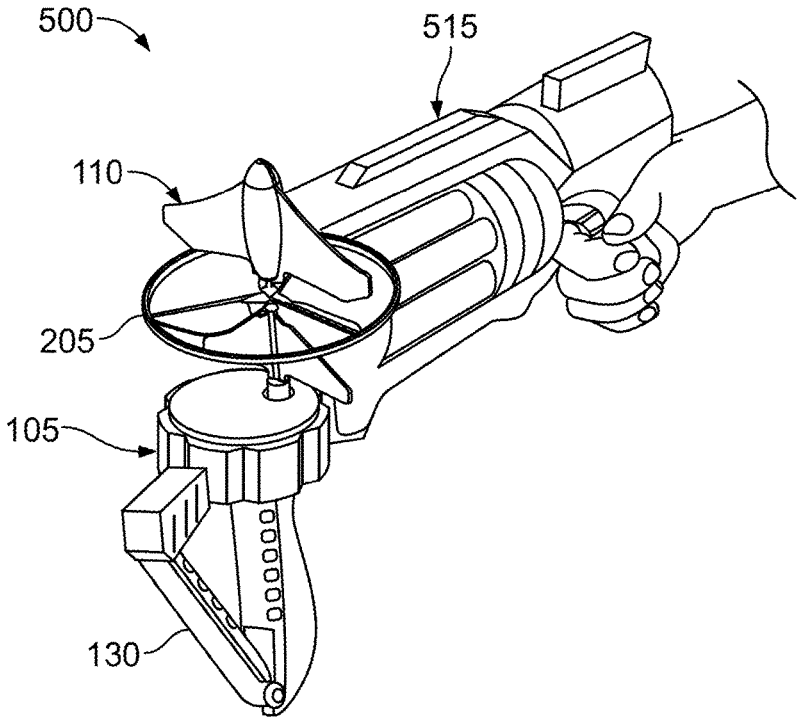
FIG. 20 is a perspective view of an exemplary system with an exemplary launch mechanism, an exemplary flying entity and an exemplary projectile launcher.
Figure 21:
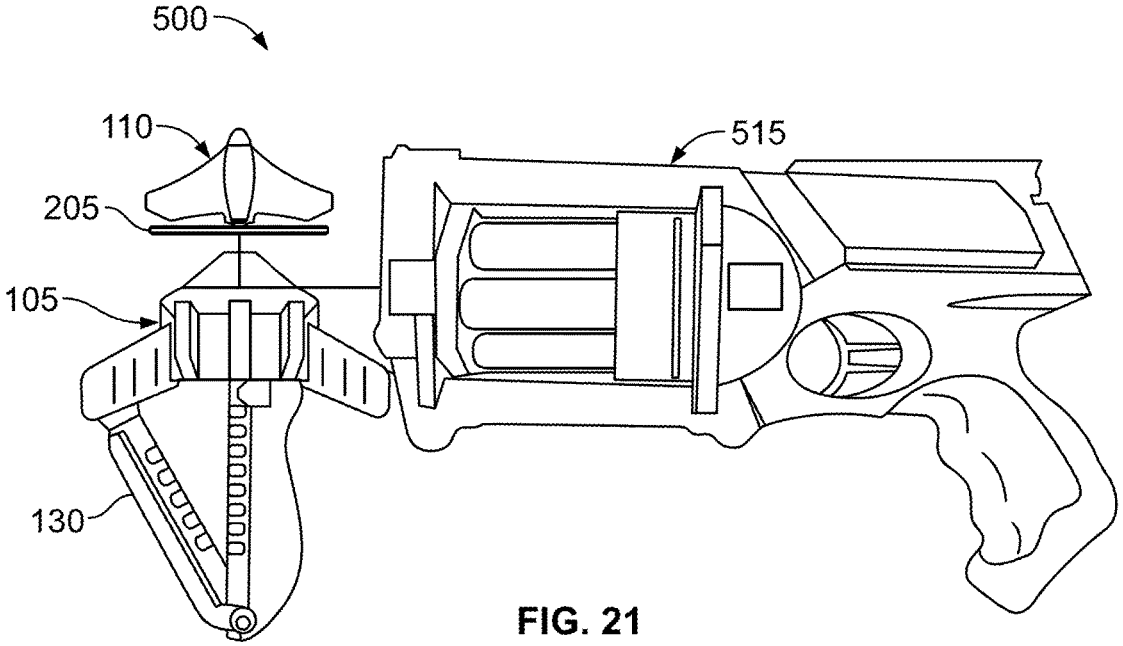
FIG. 21 is a side view of FIG. 20.

Referring now to FIGS. 20 and 21, there is shown an illustrative system 500 which may include the launch mechanism 105 with an energy generation capability, a capability to launch the flying entity 110, and an exemplary projectile launcher 515. This illustrative system 500 provides another exemplary method of game play. The launch mechanism 105 may be secured to the projectile launcher 515 and/or removeably attached to provide for independent play. Similar to the method of game play described above, a user positions the flying entity 110 in a ready position where the flying entity 110 and launch mechanism are in meshed communication to begin game play. The user may then be directed to squeeze the trigger 130 to initiate the energy generation capability and launch the flying entity 110 to direct the flying entity 110 to take flight as described above. Once in flight, the object of this exemplary game is to "shoot down" the flying entity 110 before landing and/or crashing on a surface. As such, the player is directed to follow the flight of the flying entity 110 and position the projectile launcher 515 to fire one or more projectiles, such as a dart. A player may win one exemplary method of game play by shooting down the flying entity 110. In the event a user is not able to shoot down the flying entity 110, the user may manually reposition the flying entity 110 in the ready position and begin game play again. Additionally, alternative styles of flying entities, including but not limited to a helicopter or bird, may be utilized to expand and/or vary game play. Game play may also include more than one launch mechanism, or one or more projectile launchers so that two players may compete to shoot down the flying entity.

Figure 22:
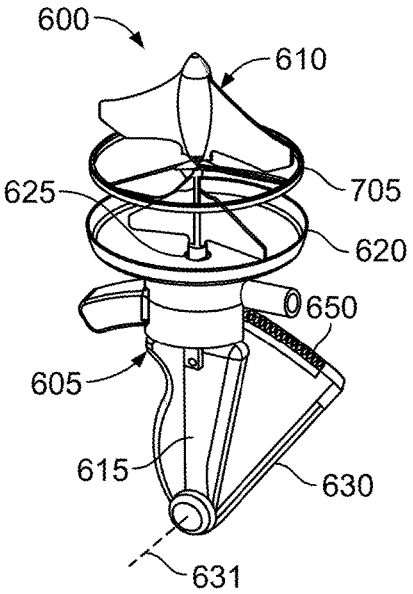
FIG. 22 is a perspective view an illustrative system in an exemplary first configuration with an exemplary launch mechanism and an exemplary first flying entity.
Figure 23:
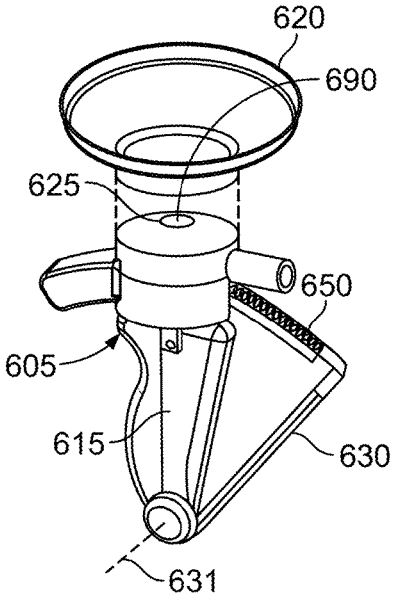
FIG. 23 is a perspective view of the launch mechanism from FIG. 22 with an exemplary upper portion removed.
Figure 24:
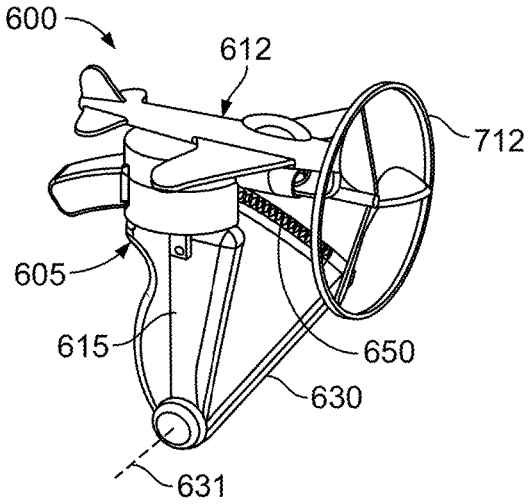
FIG. 24 is a perspective view of the exemplary system from FIG. 22 in an exemplary second configuration with an exemplary second flying entity.
Figure 25:
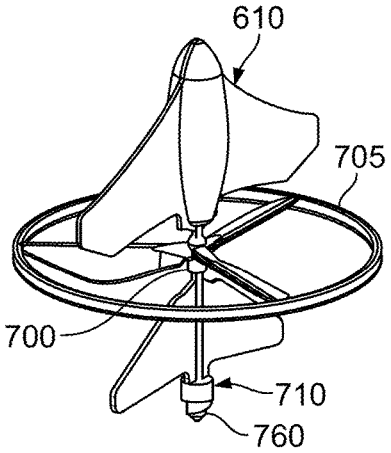
FIG. 25 is a perspective view of the first flying entity from FIG. 22.
Figure 26A:
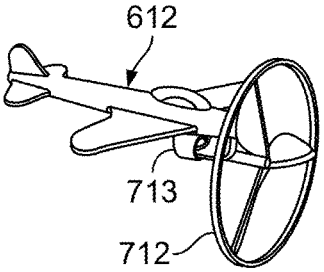
FIG. 26*a* is a perspective view of the second flying entity from FIG. 24.
Figure 26B:
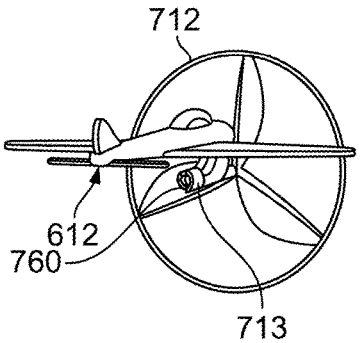
FIG. 26*b* is a rear perspective view of the second flying entity from FIG. 24.
Figure 27A:
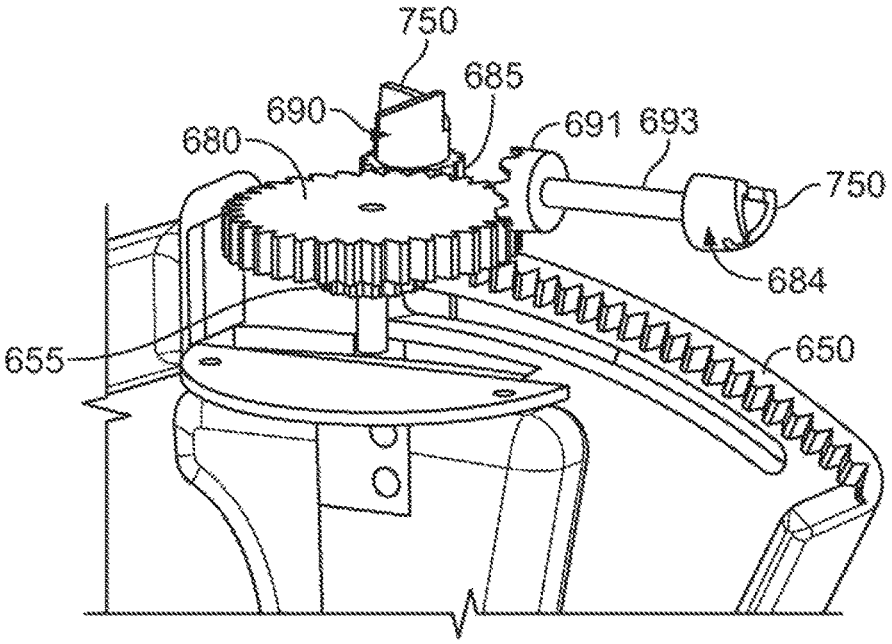
FIG. 27*a* is a detailed perspective view of the launch mechanism from FIG. 22 and FIG. 24 with an outer housing removed and an exemplary trigger in an open position.
Figure 27B:
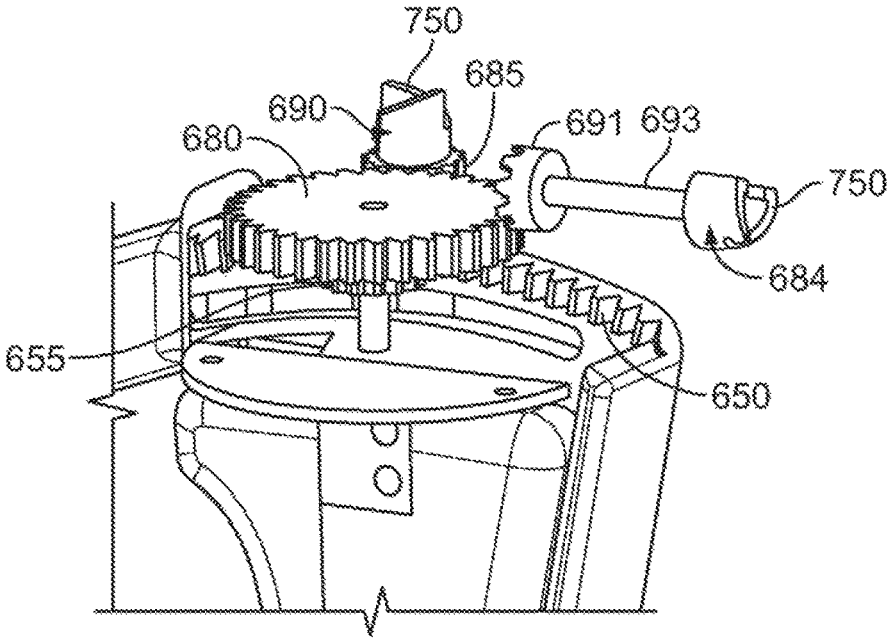
FIG. 27*b* is FIG. 27*a* with the exemplary trigger in a closed position.

Referring now to FIGS. 22-27*b*, there is shown another illustrative system 600 which may include a launch mechanism 605 with an energy generation capability and an exemplary first configuration with a capability to launch a first flying entity 610 and an exemplary second configuration with a capability to launch a second flying entity 612 in accordance with another illustrative embodiment. FIG. 22 shows an illustrative first configuration of the system 600. FIG. 23 shows a removeable upper portion 620 separated from the launch mechanism 605. FIG. 24 shows an illustrative second configuration of the system 600 where the upper portion 620 is removed and the second flying entity 612 is positioned on the launch mechanism 605. The exemplary launch mechanism 605 may include a handle 615, the removeable upper portion 620 with an aperture 625, a trigger 630 with a lower portion pivotally attached to the handle 615 at a trigger axis 631 and optionally a spring (not shown) such as a torsion spring, which may bias movement of the trigger 630 away from the handle 615. Continuing to refer to FIGS. 27*a* and 27*b*, an upper portion of the trigger 630 may include a rack 650 extending therefrom and meshed with a pinion gear 655 included in an exemplary gear box 660. Alternative gear box structures and/or configurations may be utilized. The pinion gear 655 and a transfer gear 680 may rotate in accordance with rack 650 movement. The capability to launch a first flying entity may include a second gear 685 and a first transfer fixture 690 meshed to the transfer gear 680. The first transfer fixture 690 may be aligned with the aperture 625 to further facilitate a communication with the first flying entity 610 as described below. The capability to launch a second flying entity may include a crown gear 691 meshed to transfer gear 680. A shaft 693 extends from the crown gear 691 and may include a second transfer fixture 694 fixed thereto. As such, the second transfer fixture 694 may rotate in accordance with rack 650 movement to transfer energy to the second flying entity 612 as further described below.

Referring again to FIG. 25, the first flying entity 610 may include an first entity shaft 700 with a first propeller 705 fixed thereto and a first launch fixture 710 fixed to a lower portion of the first entity shaft 700 such that the first entity shaft 700, first propeller 705 and first launch fixture 710 spin simultaneously as directed. Referring again to FIG. 26*b*, the second flying entity 612 may include a second entity shaft (not shown) with a second propeller 712 fixed at one end and a second launch fixture 713 fixed at the other end. The second entity shaft, second propeller 712 and second launch fixture 713 may spin simultaneously as directed.

The system 600 may also include a capability to transfer energy from the first transfer fixture 690 to the first launch fixture 710, and a capability to transfer energy from the second transfer fixture 694 to the second launch fixture 713. In one exemplary embodiment, the first transfer fixture 690 and second transfer fixture 694 may include a cavity and a first shaped surface 750. The first launch fixture 710 and second launch fixture 713 may include a second shaped surface 755 and an extension 760. The cavity may be shaped to receive the extension 760. The first shaped surface 750 and second shaped surface 755 may be configured to facilitate a meshed communication. Further, the first shaped surface 750 and second shaped surface 755 may be configured to facilitate disengagement of the meshed communication and launch the first flying entity 610 and second flying entity 612. Two exemplary illustrations of disengagement occur when (i) lift generated by the first propeller 705 or second propeller 694 direct the respective flying entity to take flight, and (ii) the spinning movement of first transfer fixture 690 or second transfer fixture 694 is stopped.

Figure 28A:
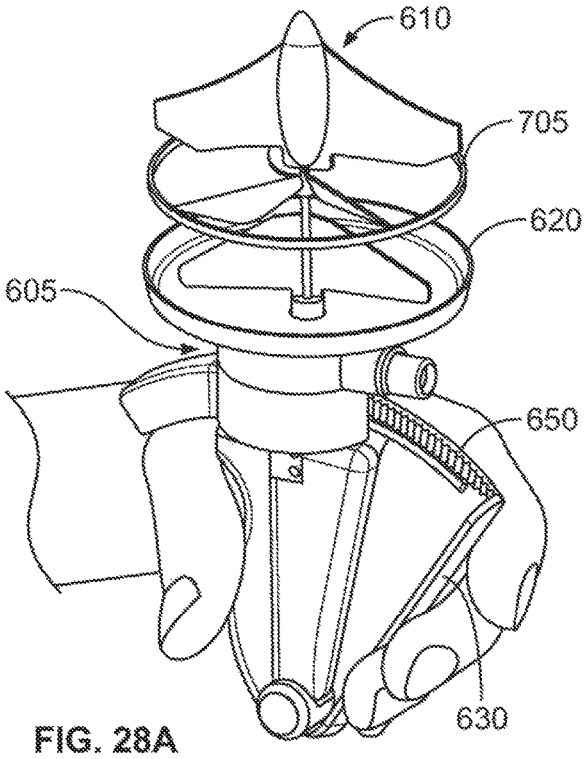
FIG. 28*a* is a perspective view of the system from FIG. 22 where the first flying entity is ready for launch by a user.
Figure 28B:
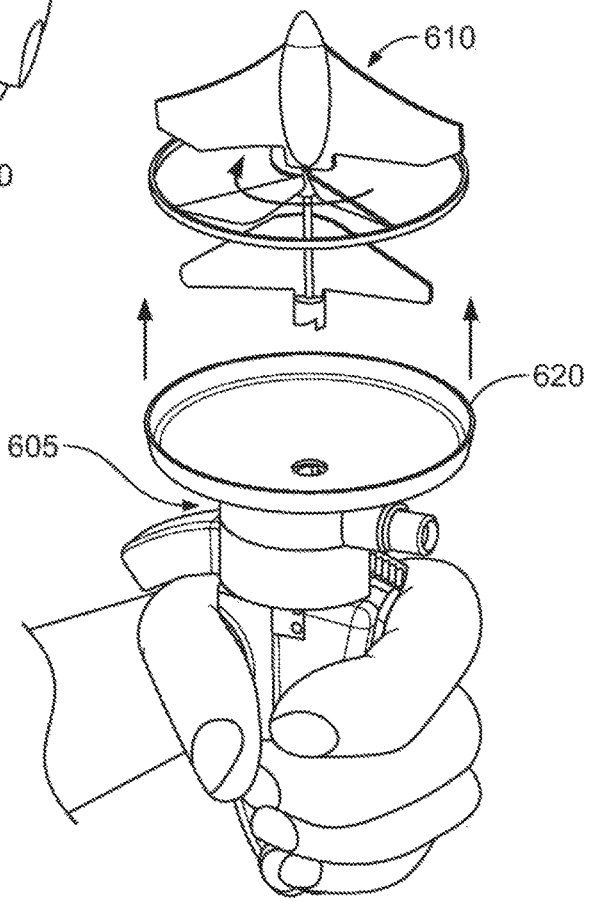
FIG. 28*b* is a perspective view of the system from FIG. 22 where the first flying entity is in flight and an exemplary trigger is in a closed position.
Figure 29A:
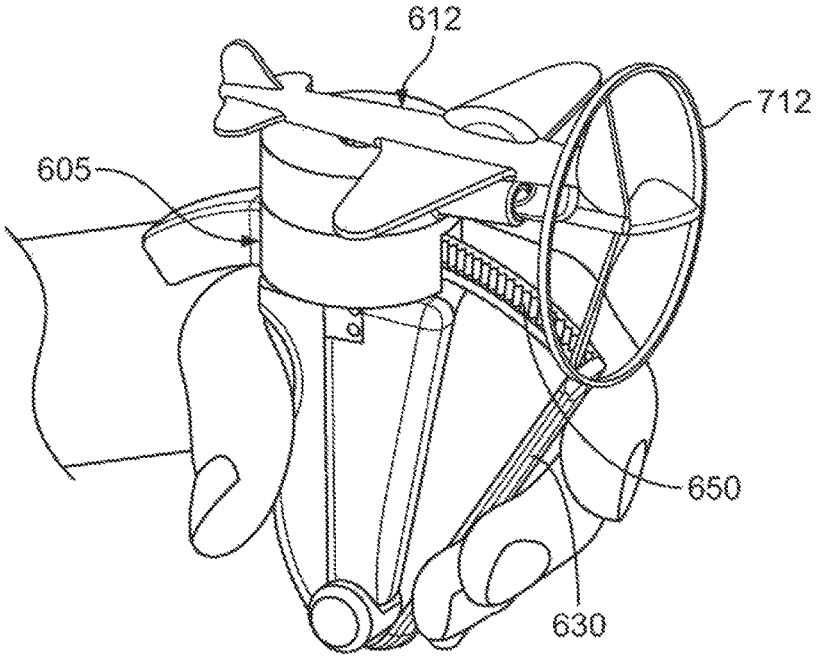
FIG. 29*a* is a perspective view of the system from FIG. 24 where the second flying entity is ready for launch by a user.
Figure 29B:
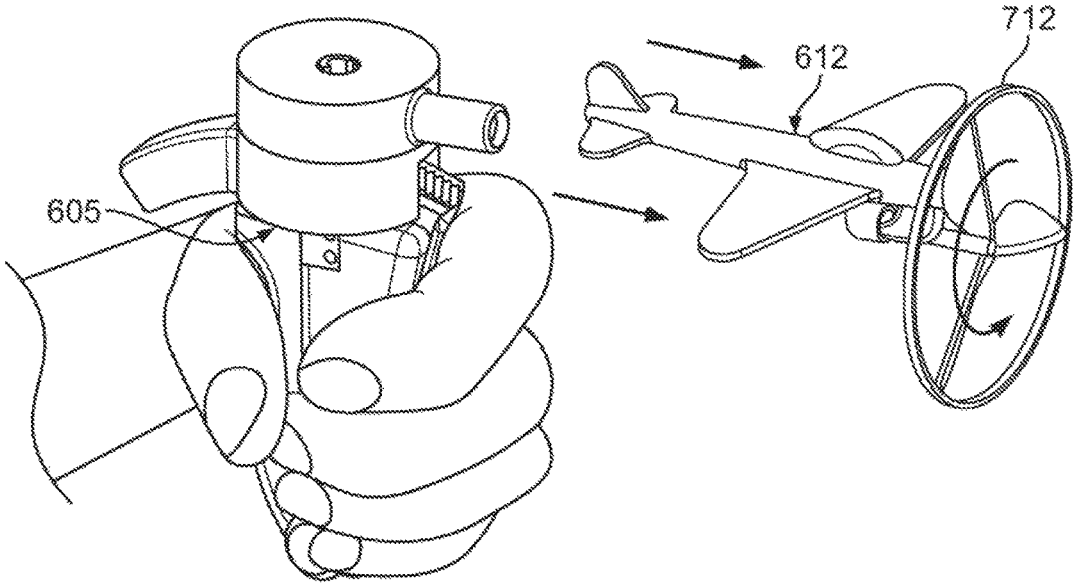
FIG. 29*b* is a perspective view of the system from FIG. 24 where the second flying entity is in flight and an exemplary trigger is in a closed position.
Figure 30:
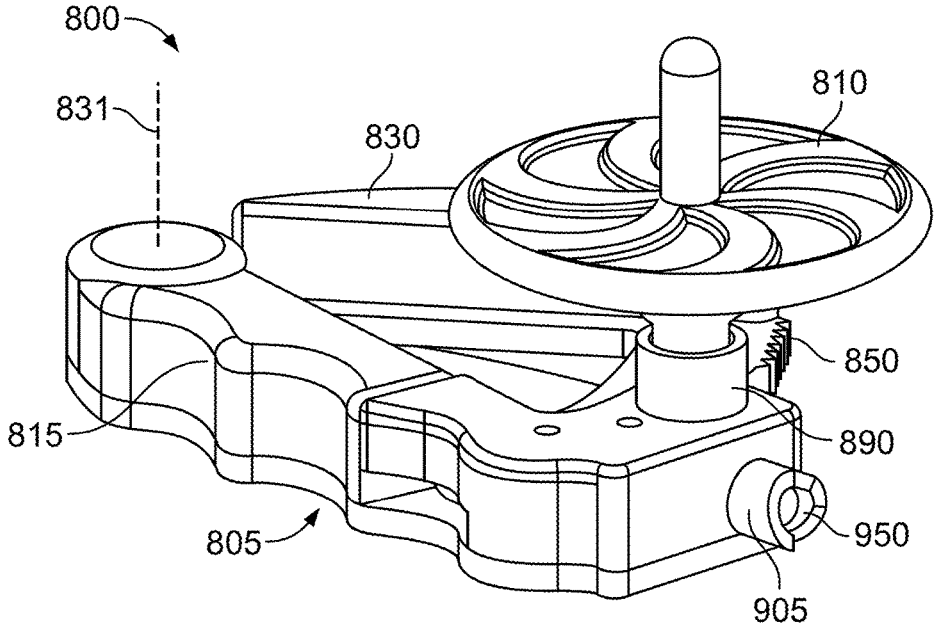
FIG. 30 is a perspective view of another exemplary system with an exemplary launch mechanism and an exemplary first entity.
Figure 31:
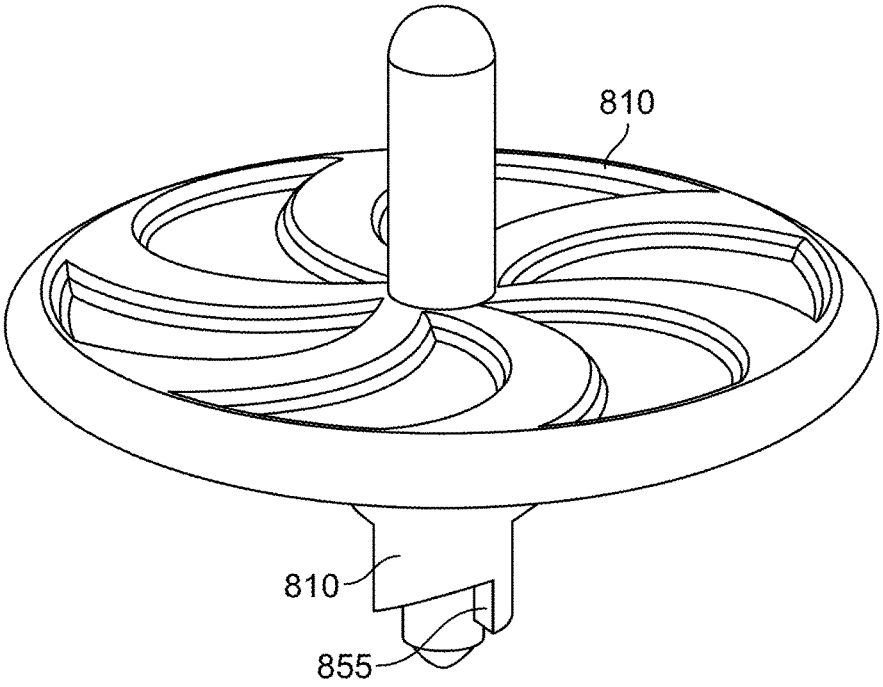
FIG. 31 is a perspective view of the exemplary entity from FIG. 30.
Figure 32:
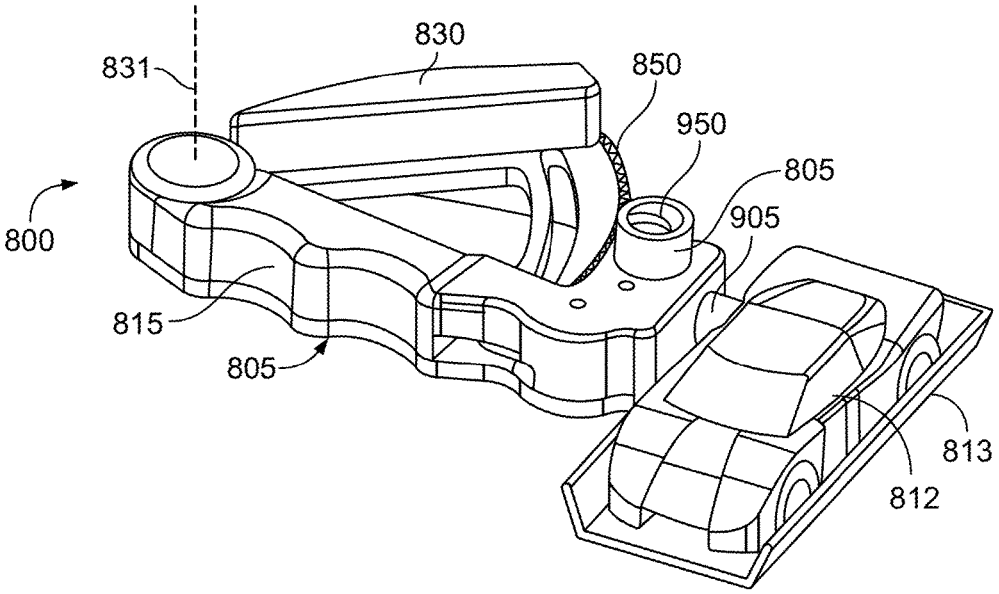
FIG. 32 is a perspective view of another exemplary system with an exemplary launch mechanism and an exemplary second entity.
Figure 33:
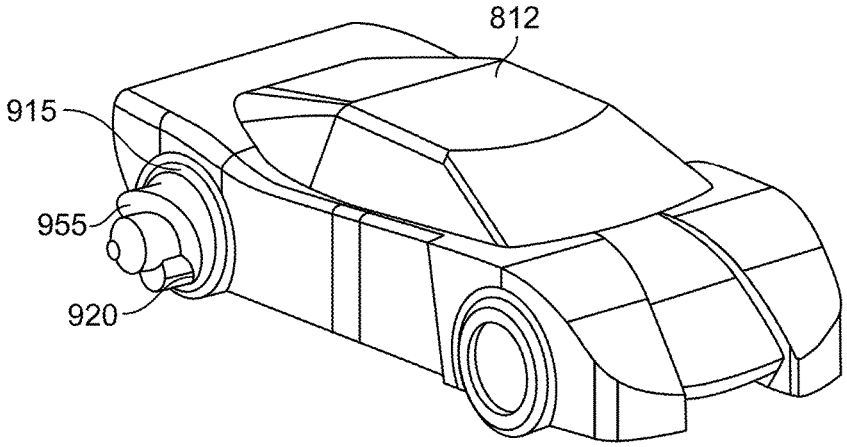
FIG. 33 is a perspective view of the second entity from FIG. 32.

Referring now again to FIGS. 28*a*-29*b*, as described above one illustrative energy generation capability utilizes an exemplary rack and pinion combination to charge the gear box 660 and initiate rotation of the first transfer fixture 690 and second transfer fixture 694. Energy may then transfer to the respective flying entity via the meshed communication between the respective transfer fixture and launch fixture. FIG. 28*a* shows an engaged position where the system 600 is in the first configuration prior to launch of the first flying entity 610. FIG. 29*a* shows an engaged position where the system 600 is in the second configuration prior to launch of the second flying entity 612. In FIGS. 28*a* and 29*a* the respective launch fixture is in meshed communication with the respective transfer fixture. The energy generation capability may require only one hand of a user to initiate an illustrative launch sequence now described. Squeezing the trigger 630 initiates a launch sequence as the rack 650 moves with the trigger 630 to charge the gear box 660. Spinning the pinion gear 655 and transfer gear 680 drive the capability launch in the first configuration and second configuration. As such, when in the first configuration and the first flying entity 610 is positioned for launch, squeezing the trigger initiates a launch sequence where the first transfer fixture 690 may spin the first launch fixture 710, first entity shaft 700 and first propeller 705, further directing the first flying entity 610 to take flight at a disengagement of the meshed communication and/or as the first propeller 705 generates lift as shown in FIG. 28*b*. As described above, the upper portion 620 may be removed such that system 600 is in the second configuration with the second flying entity 612 positioned for launch. Squeezing the trigger 630 initiates a launch sequence where the transfer gear 680 rotates the crown gear 691, shaft 693, and second transfer fixture 694. As such, the second transfer fixture 694 spins the second launch fixture 713, second entity shaft 711 and second propeller 712, directing the second flying entity 612 to take flight at a disengagement of the meshed communication and/or as the second propeller 712 generates lift as shown in FIG. 29*b*.

Referring now to FIGS. 30-35*b*, there is shown another illustrative system 800 which may include a launch mechanism 805 with an energy generation capability, a first launching capability and a second launching capability in accordance with another illustrative embodiment. In an exemplary first configuration of the system shown in FIG. 30, the first launching capability may launch a first entity 810. In an exemplary second configuration of the system 800 shown in FIG. 32, the second launching capability may launch a second entity 812. One exemplary embodiment of the first entity 810 is a top. One exemplary embodiment of the second entity 812 is a car. Additional entity embodiments may be utilized with the system 800. A removeable track 813 may optionally be included for use with the second configuration. The exemplary launch mechanism 805 may include a handle 815, a trigger 830 with a lower portion pivotally attached to the handle 815 at a trigger axis 831, and optionally a spring (not shown) such as a torsion spring which may bias movement of the trigger 830 away from the handle 815. An upper portion of the trigger 830 may include a rack 850 extending therefrom and meshed with a pinion gear 855 included in an exemplary gear box 860. Alternative gear box structures and/or configurations may be utilized. The pinion gear 855 and transfer gears 880 may rotate in accordance with rack 850 movement. A first gear 885 may be in communication with the transfer gears 880 to direct movement of a first transfer fixture 890. A crown gear 900 may be in communication with the first gear 855 to direct movement of a second transfer fixture 905. The first entity 810 may include a first launch fixture 910. The second entity 812 may include a wheel 915 with a second launch fixture 920 at a center of the wheel 915 such that the wheel 915 and second launch fixture 920 spin simultaneously as directed.

Referring again to FIGS. 34*a*-35*b*, the system 800 may also include a capability to transfer energy from the first transfer gear 890 to the first launch fixture 910, and a capability to transfer energy from the second transfer fixture 905 to the second launch fixture 920. The first transfer fixture 890 and second transfer fixture 905 may include a cavity and a first shaped surface 950. The first launch fixture 890 and second launch fixture 905 may include a second shaped surface 955 with an extension. The cavity may be shaped to receive the extension. The first shaped surface 950 and second shaped surface 955 may be configured to facilitate a meshed communication. Further, the first shaped surface 950 and second shaped surface 955 may be configured to facilitate disengagement of the meshed communication to launch the first entity 810 and second entity 812 when gear box 860 is charged.

Figure 34A:
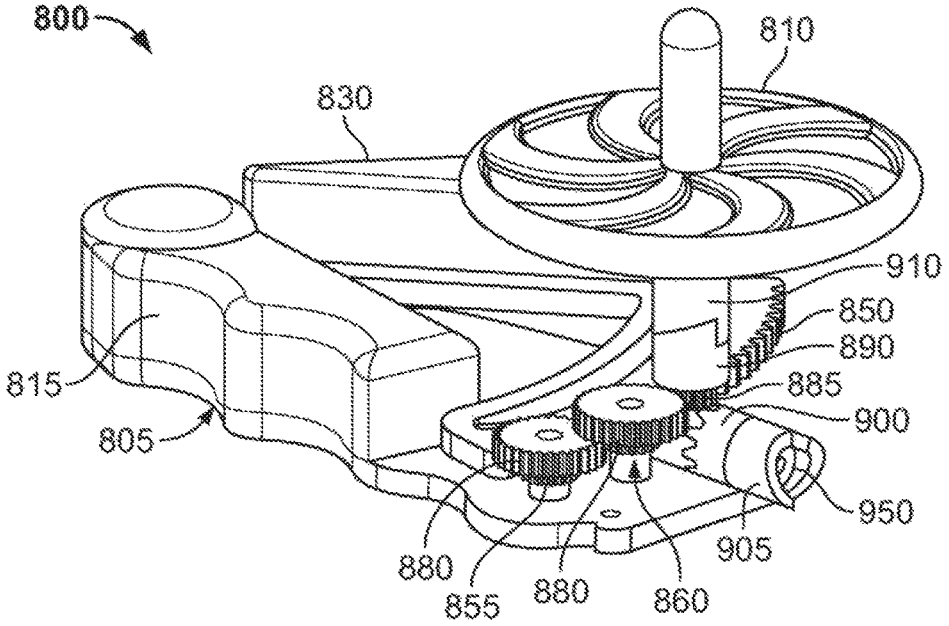
FIG. 34*a* is a perspective view of the system from FIG. 30 with an outer housing removed to show internal elements of the launch mechanism where the first entity is ready for launch.
Figure 34B:
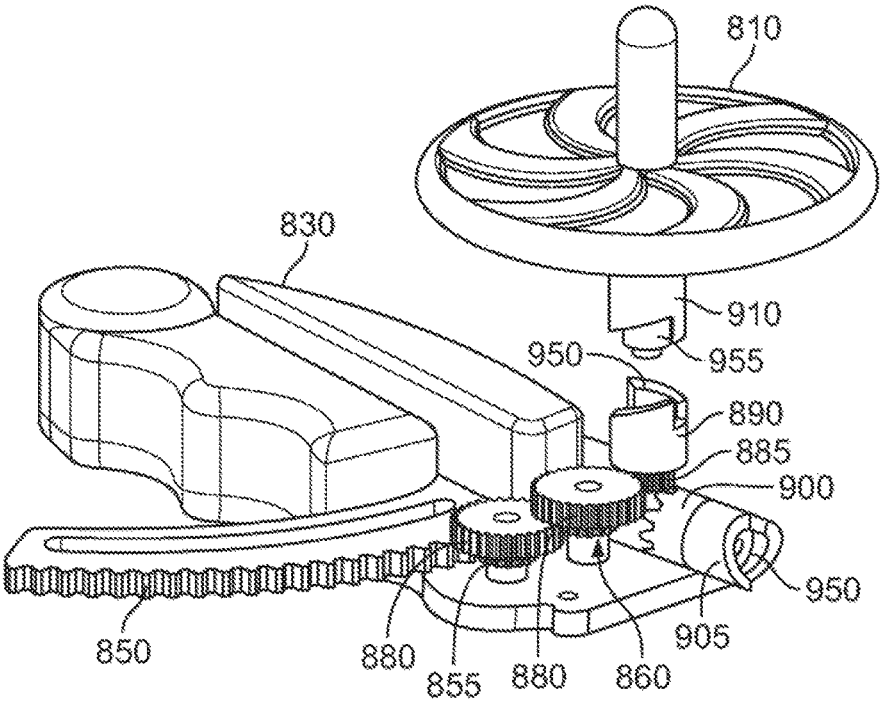
FIG. 34*b* is a perspective view of the system from FIG. 34*a* where an exemplary trigger is in a closed position and the first entity has disengaged from the launch mechanism.
Figure 34C:
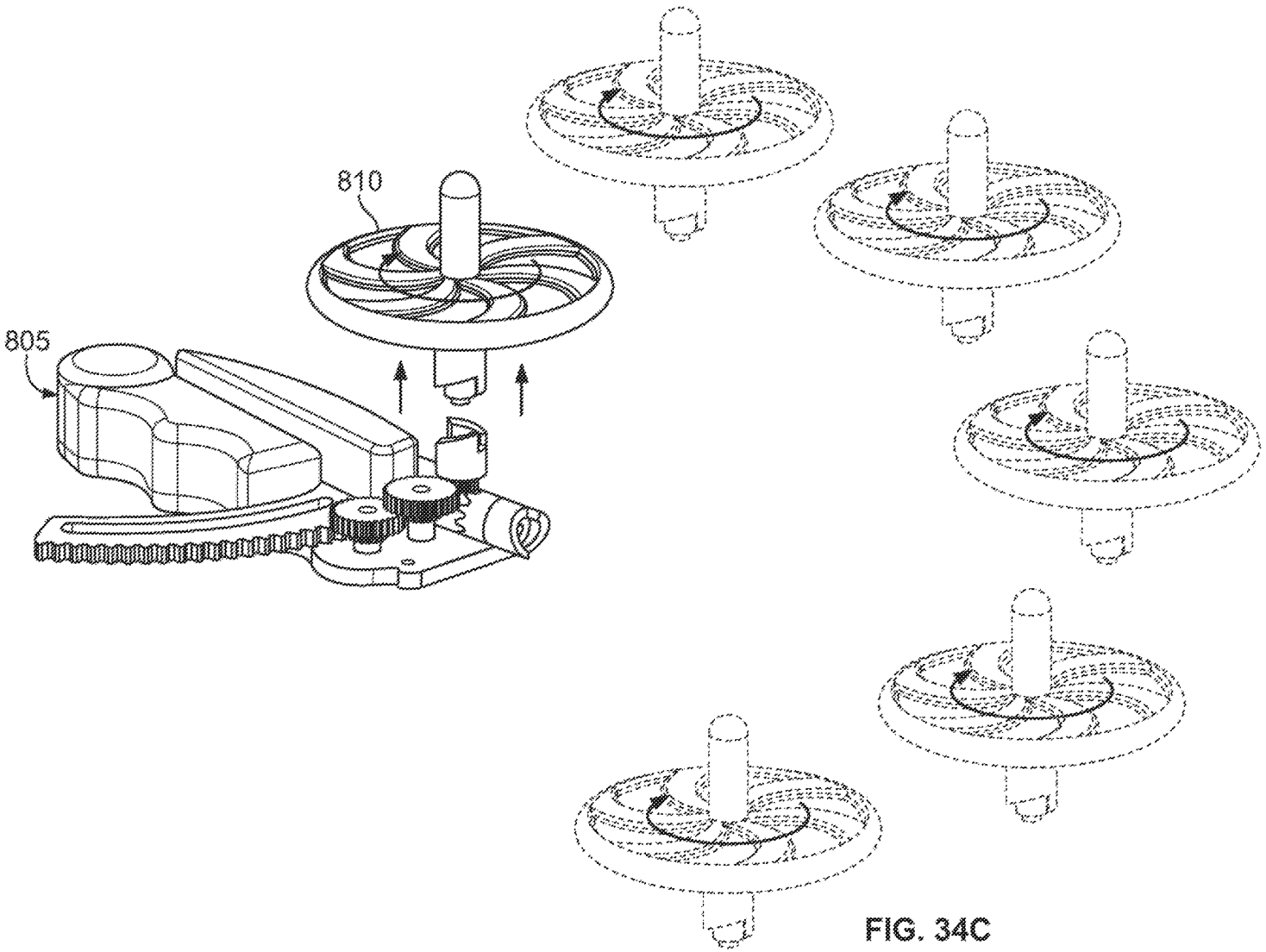
FIG. 34*c* is a perspective view of an exemplary launch sequence of the first entity where the first entity disengages from the launch mechanism and spins on a surface.
Figure 35A:
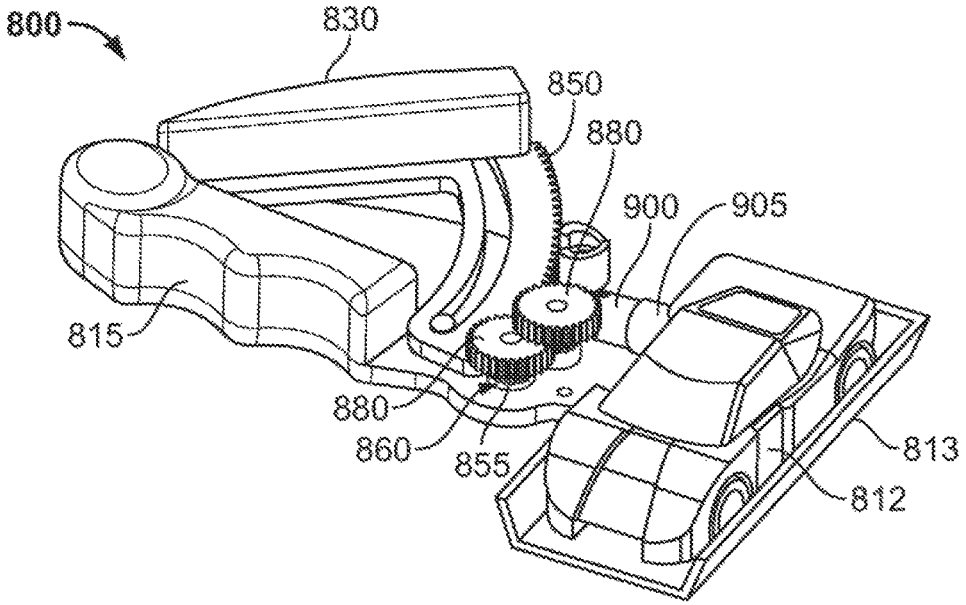
FIG. 35*a* is a perspective view of the system from FIG. 32 with an outer housing removed to show internal elements of the launch mechanism where the second entity is ready for launch.
Figure 35B:
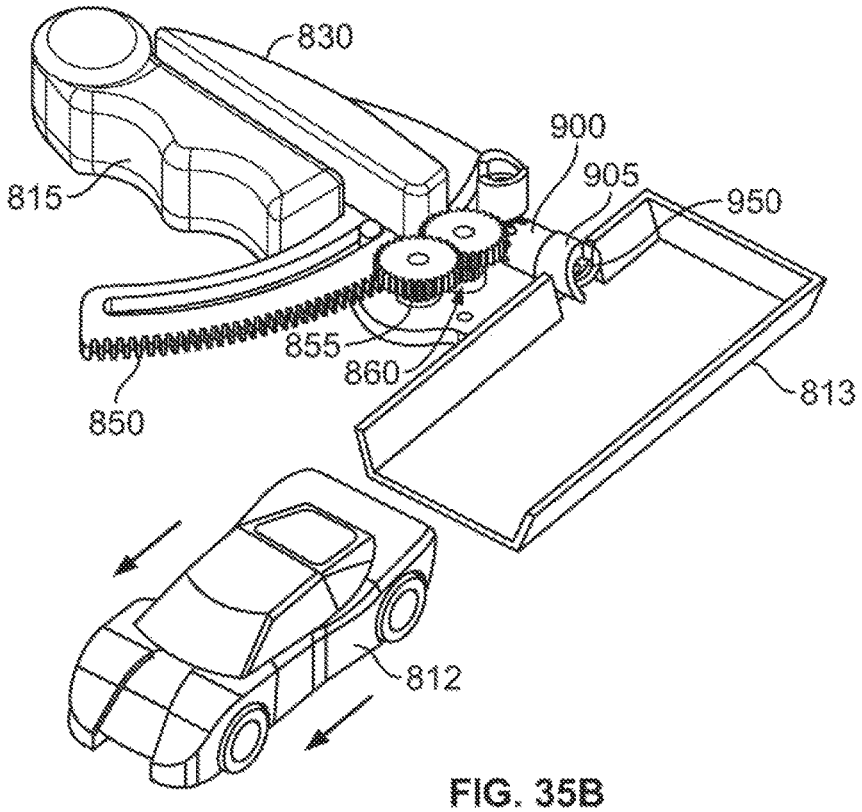
FIG. 35*b* is a perspective view of an exemplary launch sequence of the second entity where the second entity has launched forward on a surface.

FIGS. 34*a*-34*c* show an exemplary launch sequence of the first launching capability. FIGS. 35*a* and 35*b* show an exemplary launch sequence of the second launching capability. Prior to initiating a first entity launch sequence or a second entity launch sequence, the respective entity is placed in an engaged position as shown in FIGS. 34*a* and 35*a* further described below.

A mentioned above, one illustrative energy generation capability utilizes an exemplary rack and pinion combination to charge the gear box 860 and initiate rotation of the transfer gears 880, the first transfer fixture 890 and second transfer fixture 920. A user squeezes the trigger 830 to charge the gear box 860 to generate energy and direct movement of the respective transfer fixture. Energy may then transfer to the first entity 810 or to the second entity 812. FIG. 34*a* shows an engaged position where the first transfer gear 890 and first launch fixture 910 are in meshed communication and the first entity 810 is ready for launch. FIG. 35*a* shows an engaged position where the second transfer fixture 905 and the second launch fixture 920 are in meshed communication and the second entity 812 is ready for launch. The energy generation capability may require only one hand of a user to initiate two illustrative launch sequences now described. In each of the illustrative launch sequences, squeezing the trigger 830 moves the rack 850 to charge the gear box 860 by spinning the pinion gear 855 and transfer gears 880. As such, the transfer gear 880 spins the first gear 885 and the crown gear 900. When the system 800 is in the first configuration, the first transfer fixture 890 transfers energy to the first entity 810 and directs the first entity 810 to launch and spin on a surface in a top-like manner. When the system 800 is in the second configuration, the second transfer fixture 905 transfers energy to the second entity 812 and to direct the vehicle to launch forward on a surface.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or inferred.

We claim:

1. A system to launch a flying entity comprising:

a housing including a handle;

a charge mechanism including a gear box and a first transfer fixture mounted to and within the housing;

a detachable receiving member mounted to an upper portion of the housing, having a lip extending about a circumference of the receiving member, and defining an aperture above the first transfer fixture and a plate surface having a continuous slope from the lip to the aperture;

a trigger mounted to a lower portion of the handle for rotational movement of one end of the trigger;

a rack secured to the one end of the trigger and meshed with the charge mechanism to charge the charge mechanism and rotate the first transfer fixture;

a pinch prevention member mounted to the trigger to eliminate open space between the trigger and handle; and a detachable flying entity including a propeller and a first launch fixture sized to mesh with the first transfer fixture such that movement of the trigger spins the first transfer fixture and flying entity to generate lift of the flying entity via the propeller.

2. The system of claim 1, wherein the first transfer fixture and the first launch fixture are shaped to:

(i) facilitate a meshed communication therebetween to transfer energy; and (ii) facilitate a disengagement of the meshed communication when lift generated by the propeller directs the flying entity to take flight.

3. The system of claim 1, wherein the first transfer fixture and the first launch fixture are shaped to:

(i) facilitate a meshed communication therebetween; and (ii) facilitate a disengagement of the meshed communication when the first transfer fixture stops spinning.

4. The system of claim 1, wherein the lip and aperture are arranged with one another such that a flying entity spinning and contacting the receiving member is directed toward the aperture.

5. The system of claim 1 further comprising a projectile launcher including a forward portion sized to receive the housing.

6. The system of claim 1 further comprising:

a second transfer fixture in communication with the charge mechanism, oriented in a substantially perpendicular position relative to the first transfer fixture, and accessible when the receiving member is removed; and a second flying entity including a second propeller and a second launch fixture sized to mesh with the second transfer fixture.

7. A system to launch a toy flying entity and a toy driving entity comprising:

a housing including a handle and defining a first vertical configuration and a second horizontal configuration;

a detachable receiving member mounted to an upper portion of the housing, having a lip extending about a circumference of the receiving member, and defining an aperture and a plate surface having a continuous slope from the lip to the aperture;

a charge mechanism including a gear box, a first transfer fixture vertically oriented and located below the aperture, and a second transfer fixture accessible when the receiving member is detached in the second horizontal configuration;

a trigger mounted to a lower portion of the handle for rotational movement of one end of the trigger;

a rack secured to the one end of the trigger and meshed with the charge mechanism to charge the charge mechanism and rotate the first transfer fixture and the second transfer fixture;

a pinch prevention member mounted to the trigger to eliminate open space between the trigger and handle;

a flying entity including a propeller and a launch fixture sized to mesh with the first transfer fixture such that movement of the trigger spins the first transfer fixture and flying entity to generate lift of the flying entity via the propeller; and a driving entity having a launch fixture mounted to a wheel and sized to mesh with the second transfer fixture such that movement of the trigger spins the second transfer fixture and the wheel to generate forward movement of the driving entity upon an underlying surface.

8. A system to launch a first flying entity and a second flying entity comprising:

a housing including a handle;

a detachable receiving member mounted to an upper portion of the housing, having a lip extending about a circumference of the receiving member, and defining an aperture and a plate surface having a continuous slope from the lip to the aperture;

a charge mechanism mounted within the housing and including a gear box, a first transfer fixture vertically oriented and located below the aperture, and a second transfer fixture horizontally oriented and accessible when the receiving member is detached;

a trigger mounted to a lower portion of the handle for rotational movement of one end of the trigger;

a rack secured to the one end of the trigger and meshed with the charge mechanism to charge the charge mechanism and rotate the first transfer fixture and the second transfer fixture;

a pinch prevention member mounted to the trigger to eliminate open space between the trigger and handle;

a first flying entity including a propeller and a first launch fixture sized to mesh with the first transfer fixture such that movement of the trigger spins the first transfer fixture and flying entity to generate lift of the first flying entity via the propeller for vertical flight; and a second flying entity including a propeller extending from a second launch sized to mesh with the second transfer fixture such that movement of the trigger spins the second transfer fixture and the propeller to generate lift of the second flying entity via the propeller for horizontal flight.

9. The system of claim 8, wherein the second flying entity is a plane.

10. The system of claim 8, wherein the second flying entity is a dart.

11. The system of claim 8, wherein the lip and aperture are arranged with one another such that a flying entity spinning and contacting the receiving member is directed toward the aperture.

12. A system to launch a first entity and a second entity comprising:

a housing including a handle and sized for resting upon an underlying surface;

a charge mechanism including a gear box, a first transfer fixture mounted to the housing and oriented substantially parallel relative to the underlying surface, and a second transfer fixture mounted to the housing and oriented substantially perpendicular relative to the underlying surface;

a trigger mounted to the handle for rotational movement of one end of the trigger;

a rack secured to the one end of the trigger and meshed with the charge mechanism to charge the charge mechanism and rotate the first transfer fixture and the second transfer fixture;

a pinch prevention member mounted to the trigger to eliminate open space between the trigger and handle;

a detachable surface-based vehicle having a first launch fixture mounted to a wheel and sized to mesh with the first transfer fixture such that movement of the trigger spins the first transfer fixture and the wheel to generate forward movement of the vehicle; and a detachable top having a second launch fixture mounted to a base of the top and sized to mesh with the second transfer fixture such that movement of the trigger spins the second transfer fixture and launch the top.

* * * * *